US009508335B2

(12) United States Patent
Benattar et al.

(10) Patent No.: US 9,508,335 B2
(45) Date of Patent: Nov. 29, 2016

(54) ACTIVE NOISE CONTROL AND CUSTOMIZED AUDIO SYSTEM

(71) Applicant: STAGES PCS, LLC, Cranbury, NJ (US)

(72) Inventors: Benjamin D. Benattar, Cranbury, NJ (US); Mark E. Ungerman, Washington, DC (US)

(73) Assignee: STAGES PCS, LLC, Ewing, NJ (US)

( * ) Notice: Subject to any disclaimer, the term of this patent is extended or adjusted under 35 U.S.C. 154(b) by 6 days.

(21) Appl. No.: 14/561,972

(22) Filed: Dec. 5, 2014

(65) Prior Publication Data

US 2016/0163303 A1 Jun. 9, 2016

(51) Int. Cl.
*G10K 11/16* (2006.01)
*G10K 11/175* (2006.01)

(52) U.S. Cl.
CPC ..... *G10K 11/175* (2013.01)

(58) Field of Classification Search
CPC ..... G10K 11/1788; G10K 11/178
USPC ..... 381/71.1
See application file for complete search history.

(56) References Cited

U.S. PATENT DOCUMENTS

| | | | |
|---|---|---|---|
| 3,806,919 | A | 4/1974 | Comey |
| 4,776,044 | A | 10/1988 | Makins |
| 5,432,858 | A | 7/1995 | Clair, Jr. et al. |
| 5,581,620 | A | 12/1996 | Brandstein et al. |
| 5,619,582 | A | 4/1997 | Oltman et al. |
| 5,638,343 | A | 6/1997 | Ticknor |
| 5,668,884 | A | 9/1997 | Clair, Jr. et al. |
| 5,737,431 | A | 4/1998 | Brandstein et al. |
| 5,778,082 | A | 7/1998 | Chu et al. |
| 5,822,440 | A | 10/1998 | Oltman et al. |
| 6,462,808 | B2 | 10/2002 | Paritsky et al. |
| RE38,405 | E | 1/2004 | Clair, Jr. et al. |
| 6,959,075 | B2 | 10/2005 | Cutaia et al. |
| 7,110,552 | B1 | 9/2006 | Saliterman |
| D552,077 | S | 10/2007 | Brunner et al. |
| 7,415,117 | B2 | 8/2008 | Tashov et al. |

(Continued)

FOREIGN PATENT DOCUMENTS

| | | |
|---|---|---|
| AU | 2002300314 B2 | 2/2004 |
| AU | 2003236382 B2 | 3/2005 |

(Continued)

OTHER PUBLICATIONS

Patrick Mannion, Teardown: Analog Rules Over Digital in Noise-Canceling Headphones, EDN Network, Jan. 11, 2013, 3 pages, USA.

(Continued)

*Primary Examiner* — Simon King
(74) *Attorney, Agent, or Firm* — Mark E. Ungerman; Ungerman IP PLLC

(57) ABSTRACT

An audio customization system responsive to one or more inputs that enhance aspects of an audio output and one or more inputs that diminish aspects of an audio output. The system is set up to be able to lessen the influence of ambient audio or in some situations enhance ambient audio over source audio. The system may specify aspects of audio to be modified by specification of filtering algorithm, characterization of audio samples, monitored distortion, user selection, location specification or environmental specification.

6 Claims, 20 Drawing Sheets

(56) References Cited

U.S. PATENT DOCUMENTS

| | | | | |
|---|---|---|---|---|
| 7,475,434 | B2 | 1/2009 | Ambuske et al. | |
| 7,492,907 | B2 | 2/2009 | Klayman et al. | |
| 7,583,808 | B2 | 9/2009 | Smaragdis et al. | |
| 7,613,305 | B2 | 11/2009 | Vieilledent et al. | |
| 7,620,409 | B2 | 11/2009 | Budampati et al. | |
| 7,817,805 | B1 | 10/2010 | Griffin | |
| 7,848,512 | B2 | 12/2010 | Eldracher | |
| 7,970,150 | B2 | 6/2011 | Oxford | |
| D641,725 | S | 7/2011 | Chong et al. | |
| 7,995,770 | B1 | 8/2011 | Simon | |
| 8,064,607 | B2 | 11/2011 | Monceaux et al. | |
| 8,150,054 | B2 | 4/2012 | Andrea et al. | |
| 8,155,346 | B2 | 4/2012 | Yoshizawa et al. | |
| 8,194,873 | B2 | 6/2012 | Pan et al. | |
| 8,290,174 | B1 | 10/2012 | Simon | |
| 8,379,874 | B1 | 2/2013 | Simon | |
| 8,483,396 | B2 | 7/2013 | Amadu et al. | |
| 8,521,316 | B2 | 8/2013 | Louboutin | |
| 8,542,843 | B2 | 9/2013 | Andrea et al. | |
| 8,577,053 | B1 | 11/2013 | Simon | |
| 8,612,187 | B2 | 12/2013 | Amadu | |
| 8,768,496 | B2 | 7/2014 | Katz et al. | |
| 8,873,767 | B2 | 10/2014 | Regler | |
| 8,917,506 | B2 | 12/2014 | Diebel et al. | |
| 8,934,635 | B2 | 1/2015 | Esnault et al. | |
| 9,087,506 | B1 | 7/2015 | Kraft et al. | |
| 9,111,529 | B2 | 8/2015 | Amadu et al. | |
| 9,112,464 | B2 | 8/2015 | Amadu et al. | |
| 9,113,264 | B2 | 8/2015 | Frater | |
| 9,131,308 | B2 | 9/2015 | Kraft et al. | |
| 9,226,088 | B2 | 12/2015 | Pandey et al. | |
| 2006/0056638 | A1 | 3/2006 | Schobben | |
| 2007/0030986 | A1 | 2/2007 | McArthur et al. | |
| 2008/0174665 | A1 | 7/2008 | Enstad et al. | |
| 2009/0010443 | A1 | 1/2009 | Ahnert et al. | |
| 2010/0034396 | A1 | 2/2010 | Wollmershauser et al. | |
| 2010/0141153 | A1 | 6/2010 | Recker | |
| 2010/0239105 | A1 | 9/2010 | Pan | |
| 2011/0025912 | A1 | 2/2011 | Regler | |
| 2011/0081024 | A1 | 4/2011 | Soulodre | |
| 2012/0087507 | A1 | 4/2012 | Meyer | |
| 2013/0121505 | A1 | 5/2013 | Duraiswami et al. | |
| 2014/0044275 | A1* | 2/2014 | Goldstein | H04R 3/002 381/71.6 |
| 2014/0093093 | A1 | 4/2014 | Dusan et al. | |
| 2014/0184386 | A1 | 7/2014 | Regler | |
| 2014/0200054 | A1 | 7/2014 | Fraden | |
| 2014/0270231 | A1 | 9/2014 | Dusan et al. | |
| 2014/0301568 | A1 | 10/2014 | Amadu et al. | |
| 2015/0054913 | A1 | 2/2015 | Annau et al. | |
| 2015/0055937 | A1 | 2/2015 | Van Hoff et al. | |
| 2015/0058102 | A1 | 2/2015 | Christensen et al. | |
| 2015/0095026 | A1 | 4/2015 | Bisani et al. | |
| 2015/0206524 | A1 | 7/2015 | Kraft et al. | |
| 2015/0208170 | A1 | 7/2015 | Kraft et al. | |
| 2015/0234156 | A1 | 8/2015 | Rondinelli et al. | |
| 2015/0312671 | A1 | 10/2015 | Wiggins et al. | |
| 2015/0312677 | A1 | 10/2015 | Kraft et al. | |
| 2015/0348580 | A1 | 12/2015 | van Hoff et al. | |
| 2015/0355880 | A1 | 12/2015 | Kraft et al. | |
| 2015/0365759 | A1* | 12/2015 | Dimitriadis | G06K 9/00684 381/71.1 |
| 2015/0373474 | A1 | 12/2015 | Kraft et al. | |
| 2015/0382106 | A1 | 12/2015 | Kraft et al. | |
| 2016/0055861 | A1 | 2/2016 | Kraft et al. | |
| 2016/0057526 | A1 | 2/2016 | Jaffe et al. | |

FOREIGN PATENT DOCUMENTS

| | | | |
|---|---|---|---|
| CN | 103229160 | A1 | 7/2013 |
| DE | 102004025533 | A1 | 12/2005 |
| EP | 0653144 | B1 | 2/1998 |
| WO | WO2012048299 | A1 | 4/2012 |
| WO | 2014096861 | A2 | 6/2014 |

OTHER PUBLICATIONS

Aarti Singh, Adaptive Noise Cancellation, Dept. of Electronics & Communication, Netaji Subhas Institute of Technology, 2001, 52 pages, India.

Michael Jezierny, Brenton Keller, Kyung Yul Lee, Digital Active Noise Cancelling Headphones, School of Engineering and Applied Science, Electrical and Systems Engineering Department, Washington University in St. Louis, May 2010, 25 pages, USA.

S.J. Elliott, P.A. Nelson, Active Noise Control—Low-frequency techniques for suppressing acoustic noise leap forward with signal processing, IEEE Signal Processing Magazine, Oct. 1993, 24 pages, USA.

STMicroelectronics, STA311B Multichannel digital audio processor with FFX Datasheet, Oct. 2013, 102 pages, USA.

Maxim, Audio Design Guide, 12th Edition, Dec. 2009, 20 pages, USA.

MINIDSP, Digital Crossover Basics, 2009-2014, 4 pages, USA.

STMicroelectronics, STA308A Multi-channel digital audio processor with DDX Datasheet, Jul. 2007, USA.

FrankFSP, ConcertTronix! The Revolutionary New Way to Attend, Listen and Record Live Concerts with Your Mobile Device!, Sep. 12, 2012, USA.

AustriaMicrosystems AG-AMS AG, AS3501 AS3502 Low Power Ambient Noise-Cancelling Speaker Driver DataSheet, 46 pages, 1997-2009, Austria.

AustriaMicrosystems AG, AS3421/22 Low Power Ambient Noise-Cancelling Speaker Driver DataSheet, 61 pages, 1997-2013, Austria.

Sen M. Kuo and Dennis R. Morgan, Active Noise Control: A Tutorial Review, Proceedings of the IEEE, vol. 87, No. 6, Jun. 1999, pp. 943-973, USA.

Sen M. Kuo, Issa Panahi, Kai M. Chung, Tom Horner, Mark Nadeski, Jason Chyan, Design of Active Noise Control Systems with the TMS320 Family Application Report, Texas Instruments Digital Signal Processing Solutions, 1996, 171 pages, USA.

Amit Chowdhry, 26 Best Noise Cancelling Headphones, Pulse2.0 Technology News Since 2006, Nov. 28, 2012, http://pulse2.com/2012/11/28/best-noise-canceling-headphones/, USA.

Richard G. Baldwin, Adaptive Noise Cancellation Using Java, Java Programing Notes #2360, Apr. 18, 2006, http://www.developer.com/java/other/article.php/3599661/Adaptive-Noise-Cancellation-Using-Java.htm, USA.

FMA Solutions, Inc., Best Noise Canceling Earphones, Westone Noise Canceling Earphones, 2014, earphonesolutions.com/coofsoiseaan.html, Orlando, FL, USA.

Brad Albing, Noise-Reducing Headphones Hide Analog Heart, Jan. 24, 2013, http://www.planetanalog.com/author.asp?section_id=385&doc_id=558728, USA.

Ruckus Wireless, Inc., Best Practice Design Guide: Deploying Very High Density Wi-Fi—Design and Configuration Guide for Stadiums, 2012, http://c541678.r78.cf2.rackcdn.com/appnotes/bpg-highdensity.pdf, 2012, USA.

CNET TV, Monoprice's Noise Cancelling Headphone tries to silence critics, http://scienceheap.com/?rvq, https://www.youtube.com/watch?v=h8_PDtXQu58#t=89, Apr. 10, 2013, USA.

Haynes, Toby, A Primer on Digital Beamforming, Mar. 26, 1988, www.spectrumsignal.com, 15 pages, British Columbia, Canada.

Reppetto, Stafania and Trucco, Andrea, Designing Superdirective Microphone Arrays with a Frequency Invariant Beam Pattern, IEEE Sensors Journal, vol. 6, No. 3, Jun. 2006, pp. 737-747, Genova, Italy.

Zaunschirm, Markus and Zotter, Franz, Measurement-Based Modal Beamforming Using Planar Circular Microphone Arrays, Proc. of the EAA Joint Symposium on Auralization and Ambisonics, Apr. 3-5, 2014, pp. 75-80, Berlin, Germany.

Jiang, Wentao, "Sound of silence": a secure indoor wireless ultrasonic communication system, School of Engineering—Electrical &

(56) References Cited

OTHER PUBLICATIONS

Electronic Engineering, UCC, 2014, http://publish.ucc.ie/boolean/pdf/2014/00/09-jiang-2014-00-en.pdf, retrieved Nov. 24, 2015.
Kendall, Gary S., A 3-D Sound Primer: Directional Hearing and Stereo Reproduction, Computer Music Journal, vol. 19, No. 4 (Winter, 1995), pp. 23-46.
Lu, Yan-Chen; Cooke, Martin, Motion strategies for binaural localisation of speech sources in azimuth and distance by artificial listeners, Speech Comm. (2010) , Jun. 12, 2010, ScienceDirect.
Conexant, Conexant AudioSmart Voice & Speech Processing White Paper, Feb. 12, 2014, pp. 1-19.
Parra, Lucas; Fancourt, Craig, An Adaptive Beamforming Perspective on Convolutive Blind Source Separation, Samoff Corporation, Noise Reduction in Speech Applications, Ed. G. Davis, CRC Press, 2002, Princeton, NJ, pp. 1-18.
Geronazzo, Michelle; Bedin, Alberto; Brayda, Luca; Campus, Claudio; Avanzini, Federico, Interactive spatial sonification for non-visual exploration of virtual maps, Int. J. Human-Computer Studies, 85(2016) 4-15, 2015 Elsevier Ltd.

* cited by examiner

ACTIVE NOISE CONTROL AND CUSTOMIZED AUDIO SYSTEM

BACKGROUND OF THE INVENTION

1. Field of the Invention

The invention relates to audio processing systems and particularly customized audio adjustment systems.

2. Description of the Related Technology

Active noise reduction; active noise cancellation and active noise control are known in the prior art Elliot, S. J. et al., "Active Noise Control," IEEE Signal Processing Magazine, October 1993 (pages 12-35), the disclosure of which is expressly incorporated by reference herein, describes the history and background of active noise control systems and describes the use of adaptive filters.

Kuo, Sen M. et al., "Active Noise Control: A Tutorial Review," Proceeding of the IEEE, Vol. 87, No. 6, June 1999 (pages 943-973), the disclosure of which is expressly incorporated by reference herein, describes principles and systems for active noise control.

Kuo, Sen M. et al., "Design of Active Noise Control Systems with the TMS320 Family," Application Report, Texas Instruments Digital Signal Processing Solutions, Digital Signal Processing Products-Semiconductor Group, SPRA042, June 1996, the disclosure of which is expressly incorporated by reference herein, describes specialized digital signal processors designed for real-time processing of digitized signals and details the design of an Active Noise Control ("ANC") system using a TMS320 DSP.

United States Published Patent Application US 2014-0044275, the disclosure of which is expressly incorporated by reference herein, describes an active noise control system with compensation for error sensing at the ear drum including a subjective tuning module and user control.

Active noise control systems utilize various active filtration techniques and rely on algorithms to process source audio in order to reduce the influence of noise on the listener. This may be accompanied by modification of the source audio by combination with an "anti-noise" signal derived from comparing ambient sound to source audio at the ear of a listener.

Active noise control devices in the prior art suffer from being incapable of addressing the wide variation of ambient sound, dominant noise, acoustic sensors, specific characteristics of headphones or earphones or other listening devices, the type nature and characteristics of source audio (such as sound from a digital electronic device), and individual audio perceptions as each of these and other elements of sound interact to comprise a listening experience.

Adaptive noise cancellation is described in Singh, Arti. "Adaptive Noise Cancellation," Dept. of Electronics & Communications, Netaji Subhas Institute of Technology, (2001). http://www.cs.cmu.edu/naarti/pubs/ANC.pdf#. Accessed Nov. 21, 2014, the disclosure of which is incorporated herein. The customization according to the invention may be performed in accordance with the principles described therein.

Advancements in hearing aid technology have resulted in numerous developments which have served to improve the listening experience for people with hearing impairments, but these developments have been fundamentally limited by an overriding need to minimize size and maximize invisibility of the device. Resulting limitations from miniaturized form factors include limits on battery size and life, power consumption and, thus, processing power, typically two or fewer microphones per side (left and right) and a singular focus on speech recognition and speech enhancement.

Hearing aid technology may use "beamforming" and other methods to allow for directional sound targeting to isolate and amplify just speech, wherever that speech might be located.

Hearing aid technology includes methods and apparatus to isolate and amplify speech and only speech, in a wide variety of environments, focusing on the challenge of "speech in noise" or the "cocktail party" effect (the use of directional sound targeting in combination with noise cancellation has been the primary approach to this problem).

Hearing aid applications typically ignore or minimize any sound in the ambient environment other than speech. Hearing devices may also feature artificial creation of sounds as masking to compensate for tinnitus or other unpleasant remnants of the assistive listening experience for those suffering from hearing loss.

Due to miniature form factors, hearing aids are constrained by a severe restriction on available power to preserve battery life which results in limitations in signal processing power. Applications and devices not constrained by such limitations but rather focused on providing the highest quality listening experience are able to utilize the highest quality of signal processing, which among other things, will maintain a high sampling rate, typically at least twice that of the highest frequency that can be perceived. Music CDs have a 44.1 kHz sampling rate to preserve the ability to process sound with frequencies up to about 20 kHz. Most hearing devices sample at rates significantly below 44.1 kHz, resulting in a much lower range of frequencies that can be analyzed for speech patterns and then amplified, further necessitating the use of compression and other compensating methodologies in an effort to preserve the critical elements of speech recognition and speech triggers that reside in higher frequencies.

Hearing aids have almost always required the need to compensate for loss of hearing at very high frequencies, and given equivalent volume is much higher for very high and very low frequencies (i.e., more amplification is required to achieve a similar volume in higher and lower frequencies as midrange frequencies), one strategy has been compression (wide dynamic range compression or WDRC) whereby either the higher frequency ranges are compressed to fit within a lower frequency band, or less beneficially, higher frequency ranges are literally cut and pasted into a lower band, which requires a learning curve for the user.

For these reasons hearing aid technologies do not adequately function within the higher frequency bands where a great deal of desired ambient sound exists for listeners, and hearing aids and their associated technologies have neither been developed to, nor are capable as developed, to enhance the listening experience for listeners who do not suffer from hearing loss but rather want an optimized listening experience.

Noise reduction systems have been implemented in such a way that their use and processing is fixed across listening environments in either an On/Off paradigm or a degree of noise reduction setting, or on a frequency-specific basis utilizing multi-channel processors to apply noise reduction within specific frequency bands, however, in each of these systems, other than identifying speech within a hearing aid application, these noise reduction systems have treated all ambient noise as a single class of disturbance.

Typical hearing devices utilize either a system of a) isolating steady-state sound or other ambient sounds that do not correspond to predetermined modulation rates and peak to trough characteristics or b) measure signal to noise ratios in an ambient environment which all assume the desired "signal" is speech, or within frequency bands in a multi-channel system to similarly isolate environments in which signal to noise ratios are high (all ambient sound is not too loud and thus lower or no noise suppression across frequencies or within frequency bands is applied) or in which signal to noise ratios are low (all ambient sound is deemed to be too loud/undesirable and thus more noise suppression is applied), but the invention will allow similar systems to be employed with the fundamental and unique attribute that they will allow the listener to determine which sounds or signals in the ambient environment are desirable and to similarly determine which signals or sound profiles constitute undesired noise, thus enabling the established methodologies of utilizing modulation and other sound pattern or signal to noise methodologies to be employed in the current invention. These methodologies may incorporate the inclusion of speech, in general, as the relevant signal, or may further refine the characteristics of that speech to associate the signal with the speech of a child or of children, or certain specific individuals or sounds which incorporate speech as part of their acoustic signal, but will also focus on the limitless combination of ambient sound which are, in fact, desirable and not group all such sounds into a single group as has been done in the prior art. Headphone, earphone and other listening devices have focused on the reproduction of source audio signals at the ears of listeners and have all been developed with the assumption or belief that such source audio signal is the only source of desired sound. These listening devices later incorporated one or more microphones either for use in noise cancellation or to enable the listening devices to function as the speaking and hearing components of wireless communication devices, recognizing the benefit to users of not having to remove such listening device when using such wireless communication system. In each of these incarnations and scenarios where users may wish to communicate with others in their presence, these listening devices have muted the source sound while activating the microphone.

SUMMARY OF THE INVENTION

It is an object of the invention to overcome the current deficiency in other listening devices that treat sound other than that coming from a source signal as noise or as a disturbance by noise-canceling processes that suppress those disturbances.

The invention may, among other things, facilitate any desired interaction with sound. An audio signal may be conducted without either removing a listening device or muting or silencing a source audio signal. The invention may allow a listener to combine and customize one or more sources of sound, both ambient and otherwise, to personalize and enhance a listening experience.

It is an object of the invention to overcome the current deficiency in hearing aid and assistive listening device technologies that isolate speech within the ambient environment and classify other sound as noise or as a disturbance and thus apply noise cancellation to suppress non-speech sound and isolate and amplify speech.

It is an object of the invention to provide a system to customize audio. The customized audio system may be used to enhance desirable audio information, decrease undesirable audio information, and/or tune audio to improve listening experience.

It is an object of the invention to provide a personal active noise control system that can function using any combination of a single noise detecting microphone, two noise detecting microphones and an array of noise detection microphones (acoustic sensors).

It is an object of the invention to provide a personal active noise control system using traditional microphone technologies and MEMS or other miniature or acoustic sensors on silicon and similar technologies to maximize the amount of ambient acoustic information which can be detected so such information may be analyzed and utilized to customize the listening experience for the user.

It is an object of the invention to provide an active noise control system that allows a user to adjust the system based on personal preferences.

It is an object of the invention to provide an active noise control system that adjusts or allows a user to adjust the system to respond to environmental noise conditions.

The inventors have recognized that no pre-fixed algorithm can optimally compensate for a wide variation of noise in a matter that is optimal for an individual listener. Every individual hears sound in a different way, and noise cancellation may be optimized by providing a system that allows a user to either adjust the filtration algorithms or switch among them in a variety of ways to enhance the listening experience.

It has also been found that the wide variation of environments including background noise and dominant noise types, variations in sensor characteristics and positioning, and variation in speakers create a complex profile that cannot be adequately compensated for by static active filtration algorithms.

For this reason, the invention may involve an adjustable active filtration system in combination with customizable digital signal processing to be utilized in active noise reduction.

The invention may be implemented in either hardware or software. Hardware may be incorporated into headphones, earphones or other listening devices and may take the form of a device that can be coupled to any existing or future headphones, earphones or other listening devices. Software may be installed in either dedicated peripherals or included in the software or operating system in any mobile audio or telephony device.

It is an object of the invention to enable a consumer audio device or assistive listening device user to avoid having to choose between listening to a source signal or listening to environmental audio as captured by one or more microphones.

It an object of the invention to introduce those aspects of the ambient sound environment that a listener identifies as desirable into the source or streamed listening environment, and to make one or more adjustments to enhance the resulting combined sound.

The invention may use directional microphones, microphone arrays, omni-directional microphones, miniature or MEMS microphones (MEMS microphones are very small microphones, generally less than 1 millimeter, that can be incorporated directly onto an electronic chip and commonly uses a small thin membrane fabricated on the chip to detect sound), digital signal processes and sound filtration processes to enable listeners to actively characterize elements of the ambient sound environments in which they find themselves into desirable sound and undesirable noise, and to customize and adjust those environments specifically to tailor their noise cancellation experience. This will enable listeners to interact with the ambient sound environment without the need to remove their hearing device or otherwise mute or bypass the source signal of whatever consumer audio or mobile telephony device they might be utilizing.

It is a further object of the invention to allow users to utilize a library of predetermined desirable ambient sounds and ambient profiles or "experiences" to result in an immediately enhanced listening experience and also allow users to add additional desirable ambient sounds and listening "experiences" to their individual libraries which will provide the invention with an updated database of information. As an example, a listener may be able to hear important information or hold a conversation with another person without the need to remove the listening device or mute or bypass the source signal. As another example, a listener may be able to utilize a device according to an embodiment of the invention to filter out unwanted elements of ambient noise not relating to speech such as in a live entertainment venue where there is ambient sound that is either too loud or otherwise too distorted relative to a level which would be comfortable for the listener. An embodiment of the invention may enable the listener to customize the ambient sound environment they hear without any input signal from a mobile audio or telephony device, and to adjust a variety of features to tailor the volume and other characteristics of the ambient sound to match their desired preference. Those settings could be saved as an "experience" within their library, along with desirable ambient sounds. Each "experience" can relate to a specific type of sound or can relate to a particular listening environment, such as a car, public transportation of any kind, etc.

Similar to voice biometric applications which have been developed primarily for use in security systems, the invention may utilize sound spectrographing technology which, in recognizing that all sounds have unique characteristics which distinguish them in minute ways from other, even very similar sounds, can both record the frequency and time patterns of sounds to identify and classify them, but also effectively read existing spectrographs which may exist in a personal ambient sound library of a user, or which may otherwise reside in a database of available ambient sound spectrographs and decode such spectrographs to inform the digital signal processing and active filtration systems of those patters which should be treated as desired ambient sounds and thus included in the customized listening environment of a user when they are present in the ambient environment.

The invention may allow a user to select which sounds are to be heard from both the ambient environment and the source signal, and to apply a variety of adjustments/mixing controls to that combined sound environment to ensure the appropriate blending of the sounds, such adjustments to include, but are not limited to, relative volume, timing delays, distance compensation between microphones or both microphones and source signals and a wide variety of other adjustments.

The invention may utilize one or more appropriate noise cancelling algorithms. The invention may include manually or automatically adjusting parameters and/or coefficients of an algorithm, resulting in a change to the manner in which the algorithm suppresses noise.

The invention may enable a user to make adjustments to the characteristics of the noise cancelling experience. The adjustments may include application of predetermined algorithms to one or more frequency bands and/or one or more channels. The invention may permit generation of new or custom algorithms to facilitate the desired noise cancellation profile. The invention may permit a user to access or "download" specific algorithms that relate best to a specific environment.

The invention may enable users to utilize a library of predetermined desirable ambient sounds and to create and add to their own library of desirable ambient sounds. Desirable ambient sounds may be added, among other ways, through an interface which may allow the capture of desirable audio and generation of a sound profile. The sound profile may be added to the library and may operate to specify ambient sounds that may be exempted from noise cancellation.

According to the invention omni-directional microphones and/or directional microphones may be used. The invention may include an array of directional microphones. The array of directional microphones permits flexibility in the processing applied to audio sensed from various directions and will also facilitate the capture and subsequent analysis of many distinct characteristics of such audio for analysis and use by the invention.

Directional microphones may be used to isolate and enhance or damp audio originating from a particular direction. The system may manually or automatically focus noise cancellation functions on regions where a greater degree of ambient sound is emanating, while still capturing ambient sound, and isolating undesirable ambient noise for cancellation.

The invention may be implemented in one or more digital signal processors and/or adaptive filters operating on ambient, directional or directionless, source and noise audio in order to enhance delivery of desirable audio and damp delivery of undesirable audio. The invention may be implemented in a single device or in multiple components. The components may be connected wirelessly or in a wired fashion.

The invention may enable users to compensate or adjust for inclement listening environments, such as that experienced in a moving vehicle with the windows down or in a live entertainment venue where large speakers may be located on one side of a user, in which instance the force of the wind or the SPL of the sound creates distortion within the system; the ability of the invention to utilize an array of input microphones will enable dynamic adjustment of desired ambient sound from certain microphones or direction where the acoustic representation of wind, sound pressure or other inclement environmental sounds (included as undesirable acoustic sounds) is not registered or is registered at a lower level to be compensated to whatever degree desired by the listener either manually or automatically, with desired ambient sound captured by other microphones which are not capturing such sounds (i.e., microphones on the back, front or right side of the invention could be blended to compensate for such undesired sounds captured by the left side array for a driver with the driver side window down at high speed or a user standing to the left side of a stage in front of a stack of loudspeakers).

The invention may be utilized in a live entertainment event like a concert. A signal may be streamed or otherwise transmitted to a device embodying the invention that is simultaneously being amplified in a venue. The transmission of audio information may be related to source audio and may be similar to a "board feed" as heard by a sound engineer in a concert. The invention may allow adjustment to compensate for any time delay that might exist between the ambient sound and the source signal, and adjustments to customize the audio cancellation profile of the ambient environment.

According to a feature of the invention, a sampling process may be used to distinguish specific voices based on frequency, synchronous energy and modulation characteristics of the sampled audio. For example, the sounds of a child or a spouse or certain important sounds like an alarm, a telephone ringing, a mobile device notification, a ringtone, a doorbell, beach sounds or nature sounds.

In the inverse process, a feature of the invention may use a sampling process to permit adoption of an adaptive filter to damp undesirable sounds. The adaptive filter may alternatively be affected by predetermined audio profiles of ambient background or dominant audio to damp.

In a situation where an acoustic source signal is identical to ambient sound, such as listening to a prerecorded or direct feed sound signal that is concurrently being broadcast in the ambient sound environment, a system according to the invention may enable a noise cancelling device to recognize selected aspects of the ambient noise as desirable and thus allow the digital signal processors and filters to not treat those ambient sounds as errors or disturbances and not suppress them.

In the same manner, a system according to the invention may enable a noise cancelling device to treat any elements of the source signal that are deemed to be undesirable as noise to be suppressed. An example of this might be the voice of a particular singer or a particular feature of a song that is being listened to through a mobile device, which once registered in the acoustic domain, similar to undesirable ambient sound captured by microphones outside of the acoustic domain, can then be suppressed by the invention.

An embodiment of the invention may incorporate digital signal processing and sampling rates equivalent to those incorporated in high fidelity digital music systems matching the full range of human hearing, e.g. sampling rates of up to 44.1 kHz corresponding to the full dynamic hearing range of an individual without hearing loss.

An embodiment according to the invention may incorporate multi-channel digital signal processing to divide ambient sound environment into multiple channels based on frequency ranges, directionality, or audio characteristics, including but not limited to modulation rates that correspond to a wide variety of ambient sounds, including speech, among many others, thus enabling a system according to an embodiment of the invention to identify and learn/store characteristics of unique sounds and sound patterns for inclusion in its database. The inclusion may be subject to approval by the user.

An embodiment of the invention may dynamically adjust attenuation rates across channels and frequency ranges, may have a feature that enables a user to apply adaptive filters to each channel either independently or across all channels simultaneously.

According to a feature of an embodiment of the invention reliance on predetermined noise cancellation algorithms or predetermined signal processing which isolates only specific sounds, such as speech may be avoided.

Advantageous features of a system according to the invention may facilitate adjustment of filtration on the basis of one or more of the following characteristics, or others.

- Number of channels;
- Frequency band of each channel;
- Direction of sound sources;
- Activation of all microphones, directional microphones and omni-directional microphones, or omni-directional microphones only (applicable in situations where directional microphones or microphone arrays are unavailable);
- Signal detection methodology of acoustic measurement among modulation rates, synchronous energy (opening and closing of vocal folds) or signal to noise ratios depending on both the environment and the nature of the sound which is desirable (i.e. speech or other ambient sounds) as well as whether such sound profiles are new or already exist in the listener's library (in which case such methodology selection may be automatic);
- Spectral regions;
- Time patterns;
- Modulation;
- Rate of modulation;
- All the distances between and among microphones;
- Distances between microphones and source ambient signals;
- Attack rates (speed at which noise cancelling algorithms suppress and then restore certain targeted ranges, such as compensating for sudden, brief undesirable sounds);
- Digital signal processing programs (could include Bongiovi, Audyssey and/or others); newly created or commercially available programs, and/or
- Noise cancellation algorithms, digital signal processing or other filtration either across all channels/all frequencies or by channel or frequency range.
- Volume mix among source input and ambient sound
- Bass, treble, midrange and other equalization settings
- Ambient sound bypass or source sound bypass
- Ambient and source sound match (as a means to analyze, calculate and adjust for ambient sound characteristics that differ from source sound characteristics in a setting wherein source and ambient sound inputs are the same but for those characteristics resulting from the introduction of the source sound into the relevant ambient environment)

The various noise cancelling algorithms that may be utilized or created for use may, among other things, adjust for:

- Signal depth, typically measured by noise attenuation in decibels (-dB);
- Frequency breadth, relating to how much of the 10 hz to 20,000 hz frequency range is impacted by the noise cancellation algorithm or algorithms, which in the invention might take the form of different algorithms running simultaneously in different frequency ranges in a multi-channel system;
- Position, representing the point on the 10 hz to 20,000 hz frequency spectrum the cancellation profile is centered, which point will be subject to adjustment by the listener either by channel or by noise cancelling algorithm, depending on whether one or more channels and/or algorithms are in simultaneous use; and/or
- Boosting, which represents the extent that noise cancelling algorithms generate additional undesirable sound as a result of the suppression signal exceeding the targeted undesirable sound they are trying to suppress, which would be addressed either by overlapping other noise cancelling algorithms to capture such boosting, or by the addition of identical sound signals to offset such boosting when it appears.

Certain aspects of the adaptive filters may be adjusted in an automated fashion on the basis of adjustments not controlled by the listener, in addition to adjustments controlled by the listener. The listener advantageously may control the active filtration to compensate for background noise environments. For example, the background in an automobile, on a train, walking the street, in a workout room, or in a performance arena all have differing characteristics. Another adjustment that may be made is to compensate for the difference between the noise sensor and the speaker. This difference may be in the form of distance or audio characteristics. The background adjustment may be controlled by a smart algorithm using location services, wireless input or user input. Adjustments for reproduction device characteristic may be based on pre-established profiles or user preference. The profiles may be generic to a reproduction device class or may be specific to an individual reproduction device model.

The system may have variable inputs to compensate for dominant noise. Dominant noise may be a noise type that is different from a more steady state background noise, for example, the noise created by a conversation may be considered a dominant noise, and the noise otherwise present in the cabin of a moving vehicle—train, airplane, car—is the background noise. Another dominant noise may be noise generated by machinery or audio content of an ambient audio program.

It is possible that each of these be identified by an automated analysis of the ambient audio, and automated identification such as a beacon transmitting an identification of audio or other environmental characteristics, or a user-controlled modification.

Ultimately, the user/listener will be in the best position to make at least some adjustment to modify the active filtration algorithms to the user's preference.

An active noise control system may have an adaptive filter having a source audio input and an audio signal output. A filtration control may be connected to the adaptive filter and a variable input control may be connected to the filtration control wherein the variable input control dynamically influences the filtration control. The active noise control system may have a variable input control that is a user control. The variable input control may be a dynamic audio analysis unit; an identification based variable input control; and/or a non-audio environmental identification based variable input control. The non-audio environmental identification based variable input control may be a location service based variable input control and the location service based variable input control may further include a database containing adaptive filter parameters indexed according to non-audio parameters and a non-audio monitor connected to the database. The identification based variable input control may be an audio based variable input control which may include a database containing adaptive filter parameters indexed according to audio based parameters and may include an audio monitor connected to the database. The non-audio environmental identification-based variable input control may include an adaptive filter control responsive to an environmental input.

A method for active noise control may include the steps of setting a dynamic filtration control input parameter, establishing an adaptive filter filtration control signal based at least in part on the dynamic filtration control input parameter, modifying an audio signal to control perceived noise based at least in part on the adaptive filter filtration control signal. The step of setting a dynamic filtration control input parameter may be responsive, at least in part, to user set variable parameters. The step of setting a dynamic filtration control input parameter may be responsive, at least in part, to an audio analysis. The step of setting a dynamic filtration control input parameter may be responsive, at least in part, to a condition identification.

An audio customization system may include an adaptive filter responsive to at least one audio input, an adaptive filter parameter control connected to the adaptive filter to enhance an aspect of the audio input; and an adaptive filter parameter control connected to the adaptive filter to diminish an aspect of the audio input. The audio customization system may also include an audio sensor array of 3 or more audio sensors connected to the adaptive filter parameter control. The adaptive filter parameter control may be configured to provide directional control in response to the audio sensor array. The audio sensor array may include at least one directional audio sensor. The adaptive filter may be responsive to the audio sensor array. The invention may include an article of manufacture, a method, a system, and an apparatus for an audio customization system. The article of manufacture of the invention may include a computer-readable medium comprising software for a system for generating an audio signature or audio fingerprints. The invention may be embodied in hardware and/or software and may be implemented in one or more of a general purpose computer, a special purpose computer, a mobile device, or other dedicated or multipurpose device.

The article of manufacture of the invention may include a computer-readable medium comprising software for an active noise reduction system, comprising code segments for generating audio signatures.

The system of the invention may include a computer system including a computer-readable medium having software to operate a computer or other device in accordance with the invention.

The article of manufacture of the invention may include a computer-readable medium having software to operate a computer in accordance with the invention.

Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF PREFERRED EMBODIMENTS

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

Figure 1:
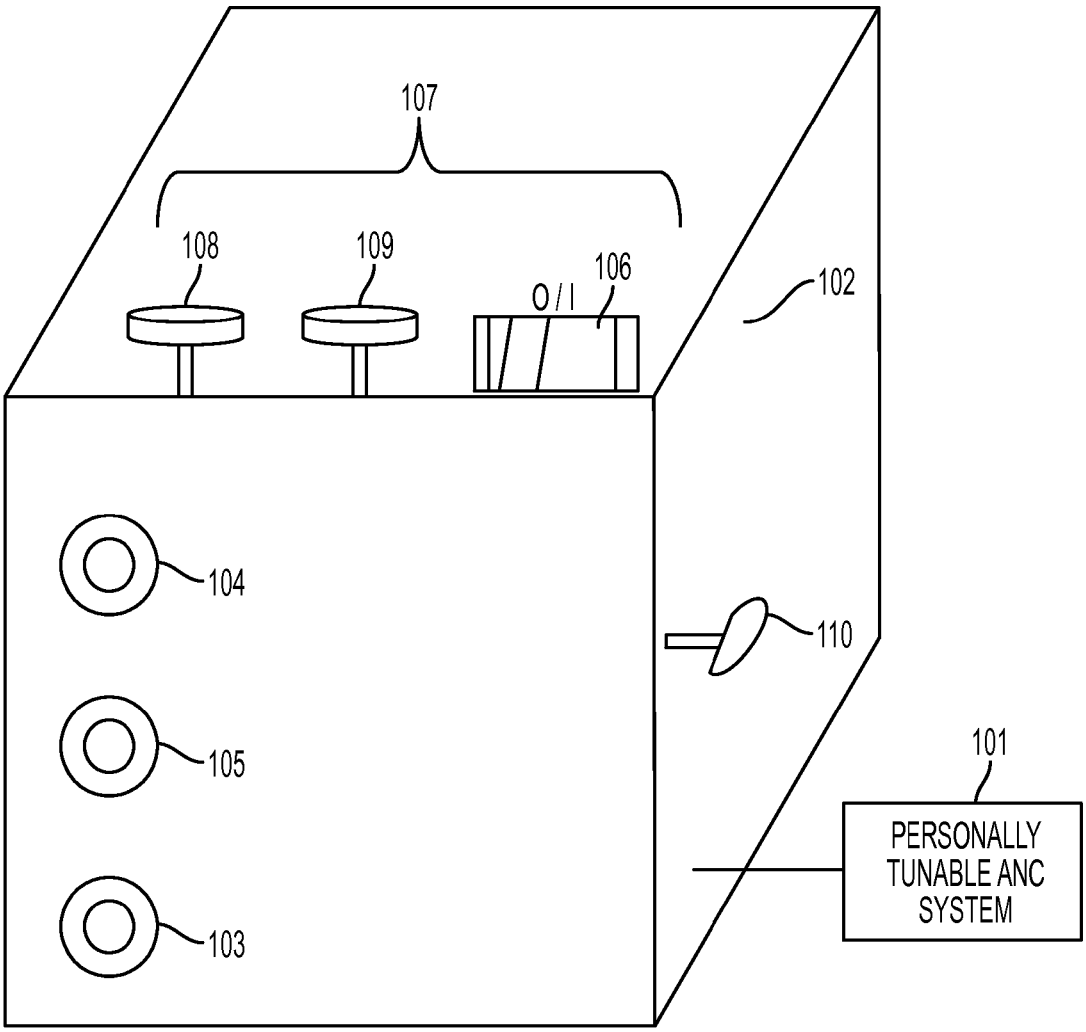
FIG. 1 shows an embodiment of the invention in the form of an auxiliary box allowing for personal tuning of an active noise reduction system.

FIG. 1 shows a personally tunable custom audio system 101 which may be suitable for Adaptive Noise Cancellation. The system may be implemented in a housing 102. The housing may be portable and have a clip for attaching to a belt, garment or exercise equipment.

Alternatively, the housing may be integrated with a case for a personal electronic device such as a smartphone or tablet.

The system may be implemented in a personal electronic device such as a smartphone or tablet.

The system may have or be connected to a noise-detecting sensor or microphone 110. The sensor may be integrated with the housing or be remote. In the case of a personal electronic device, the system may have a jack 103 for a remote noise-detecting sensor.

The system may be connected to or integrated with a sound reproduction device such as one or more speakers or headphones. The connection may be by a speaker jack 104.

The system may be connected to an audio source, for example, a personal media player such as an MP3 player. The connection may use jack 105.

The system may be provided with an on/off switch 106 and one or more user controls 107. The controls may be for one or more channels such as a left channel tune adjustment 108 and a right channel tune adjustment 109. There may be one or more controls for frequency bands per channel. Alternatively, the controls may be for degree in balance in one or more frequency bands.

Figure 2:
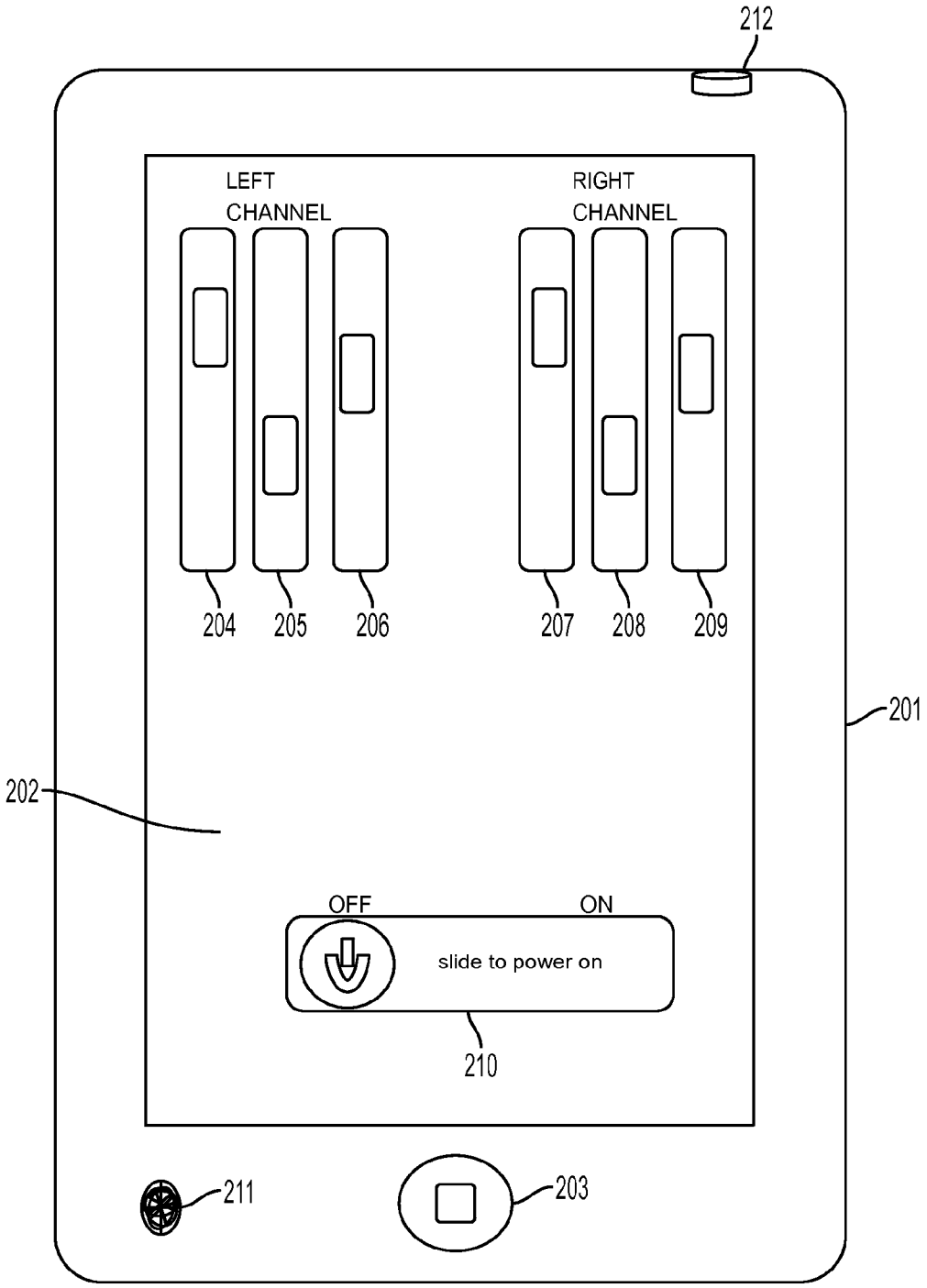
FIG. 2 shows an embodiment of the invention implemented on a personal electronic device, particularly a tablet.

FIG. 2 shows an embodiment implemented on a personal electronic device, 201, such as a tablet or smartphone. The device may have a touch screen 202 and a mechanical control 203. The device shown in FIG. 2 may be implemented in an application. FIG. 2 shows three level sliders 204, 205 and 206 for three frequency bands for the left channel and three level sliders 207, 208 and 209 for three frequency bands for the right channel. There is an on/off switch 210 that is also a touch control. The tablet 201 may have an on-board microphone 211 and a stereo headphone jack 212. Audio input may be provided by an onboard radio player or an external input.

Figure 3:
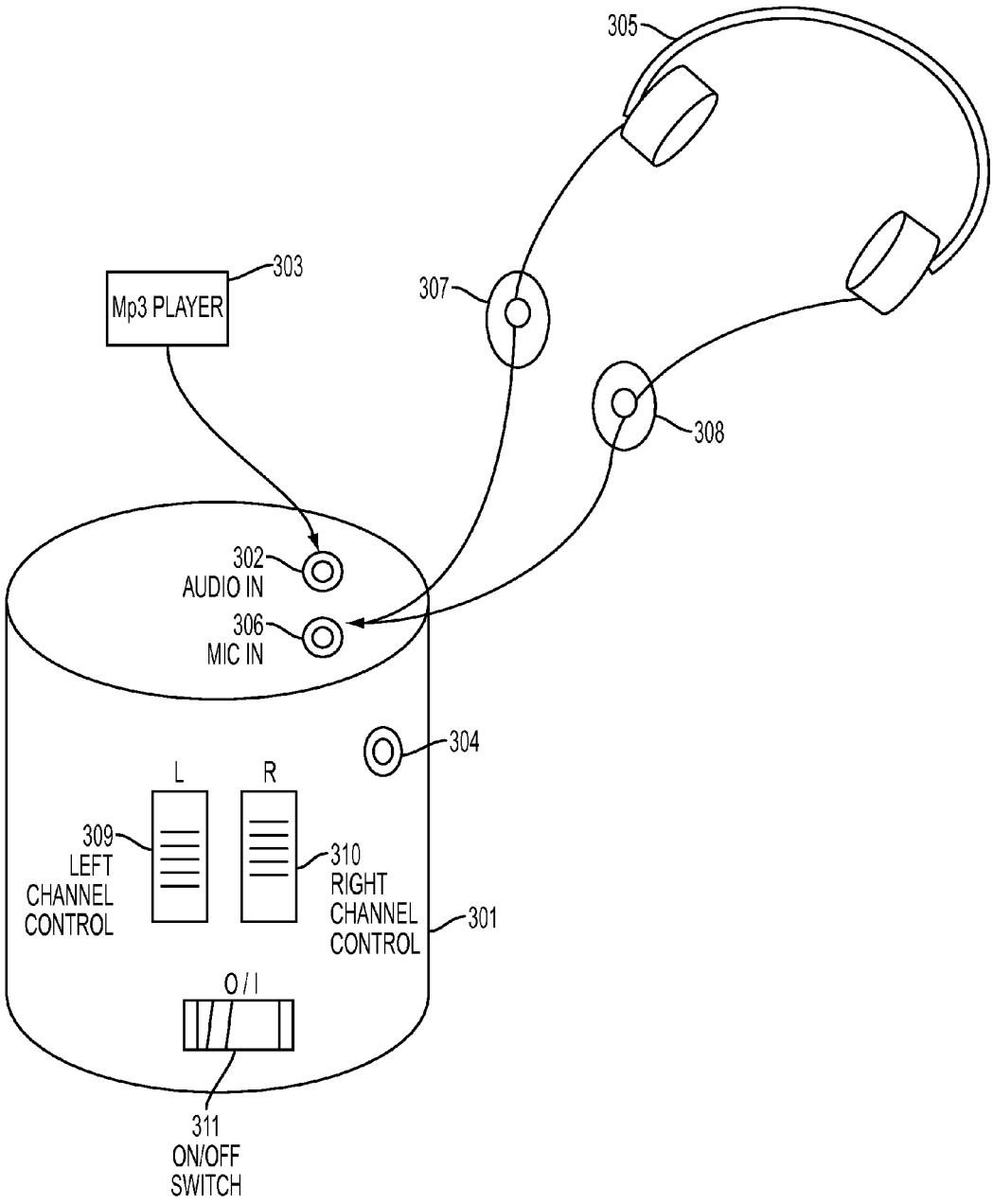
FIG. 3 shows an embodiment of the invention with two noise-sensing microphones mounted on a set of headphones.

FIG. 3 shows an embodiment with a housing 301. The housing provided with an input jack 302 which may be connected to an audio source such as an MP3 player 303. The housing 301 is provided with an audio output jack 304. Headphones 305 may be connected by a cable to the jack 304. The housing may be connected to two noise-sensing microphones 307 and 308. The microphones may be hardwired or connected with a jack.

The microphones 307 and 308 may be affixed to the headphone earpieces in a manner to approximate location of the user's ears. The housing may also include a left channel control 309, a right channel control 310, and an on/off switch 311.

According to the invention, the system may be used with or without an audio source. The system may enhance the user's listening experience by reducing the impact of external and ambient noise and sounds when used with an audio source. When used without an audio source, the system still operates to reduce the impact of external sounds and ambient noise.

Figure 4:
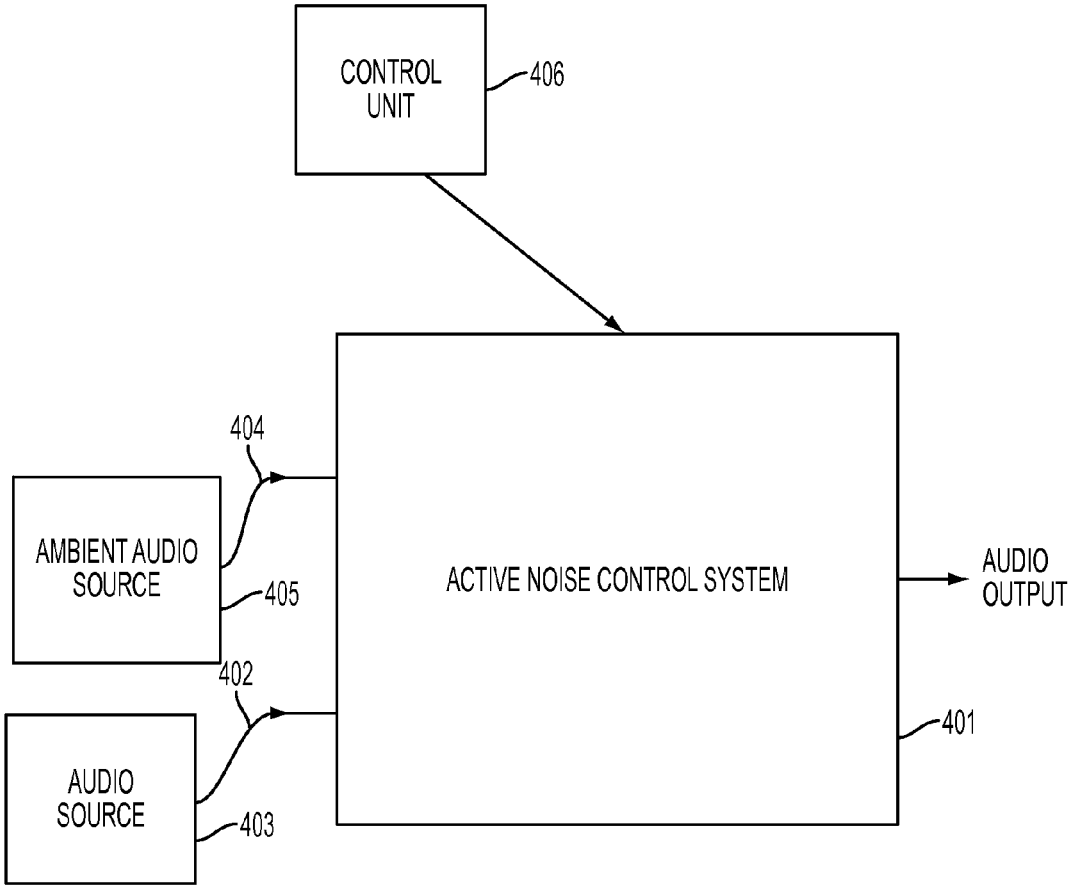
FIG. 4 shows a schematic of an embodiment of the invention.

FIG. 4 shows a schematic of an embodiment of the custom audio system according to the invention which may be an adaptive noise cancellation system.

According to an embodiment of the invention, audio is delivered to a user with a perceived reduction of noise. In addition the audio characteristics may be tailored according to a profile selected by a user, a profile determined by audio analysis, a profile indicated by a non-audio input, and/or a preset profile.

Customized audio according to an embodiment of the invention may be implemented by the use of an adaptive filter. The adaptive filter may be hardware or software implemented. A software implementation may be executed using an appropriate processor and advantageously by a digital signal processor (DSP).

An adaptive filter is a filter system that has a transfer function controlled by variable parameters. According to embodiments of the invention, an adaptive filter may allow improved control over the adjustment of the parameters.

User controlled adjustment; audio analysis driven adjustment; and/or non-audio analysis driven adjustment may be used to customize audio input. The adjustment types can be used individually, in combination with each other and/or in combination with other types of adjustment.

According to an embodiment illustrated in FIG. 4, an adaptive noise cancellation system 401 may receive a source audio signal 402 from an audio source 403 which may provide live or pre-recorded audio. Live audio may be obtained from an audio signal generator or an audio transducer, such as a microphone and analog to digital converter.

The adaptive noise cancellation system may receive an ambient audio signal 404 from an ambient audio source 405.

The ambient audio source may include one or more audio transducers such as a microphone(s) for detecting noise. According to one embodiment, two microphones may be used in positions corresponding to a user's ears. According to a different embodiment, a single microphone may be used. The single microphone may be in or connected to the system housing 102, associated with headphones in the form of a headset, or remotely located in a fixed or mobile position.

Alternatively, the ambient audio source may be an artificial source designed to provide a signal that acts as the base of the cancellation.

The active noise reduction system has a control unit 406. The control unit 406 provides parameters which define or influence the transfer function.

Figure 5:
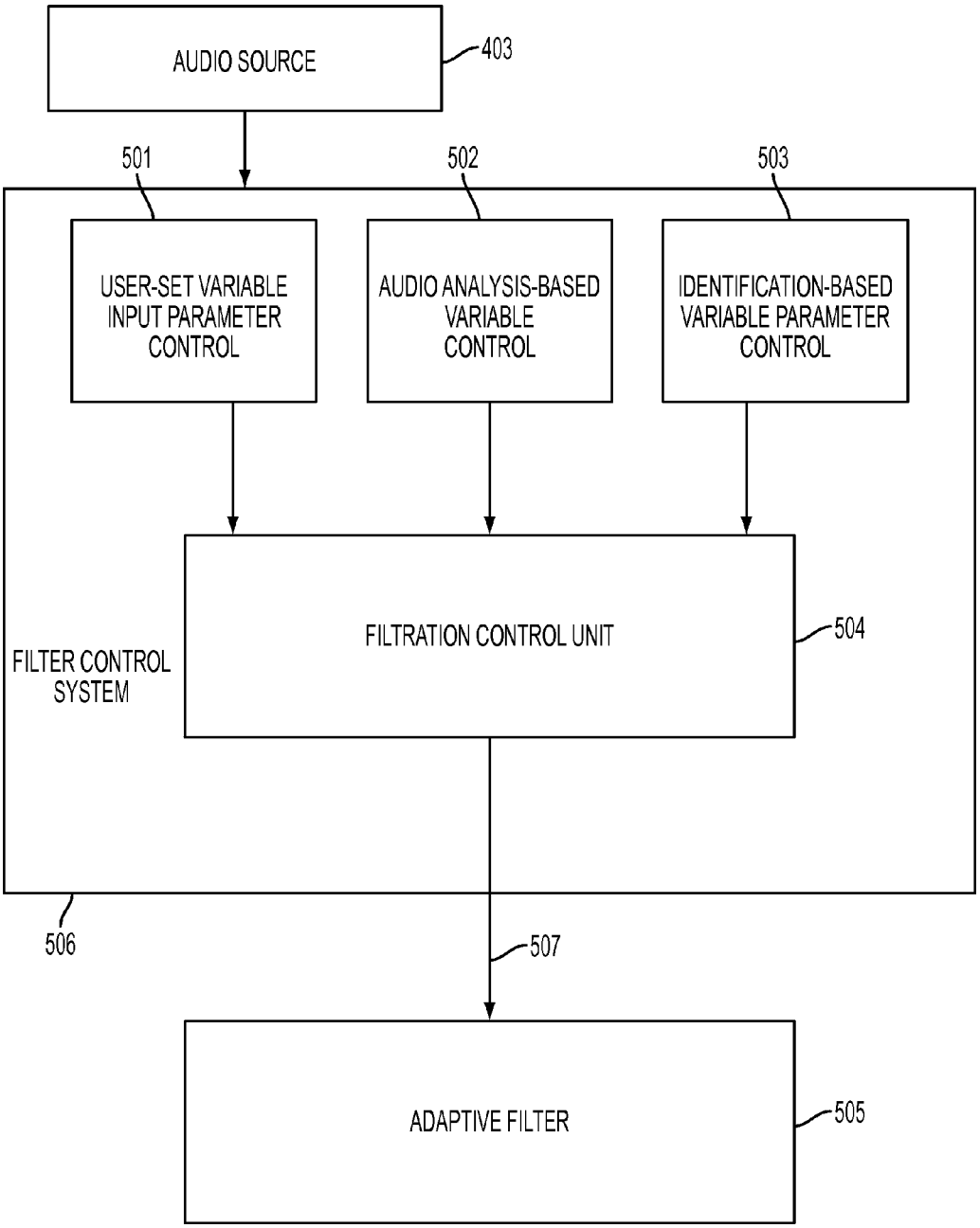
FIG. 5 shows an illustration of an adaptive filter.

FIG. 5 shows a more detailed illustration of the adaptive filter 505 and filter control system 506. The filter control system 506 responds to user variable input parameter control 501, audio analysis based variable control 502, and identification based variable parameter control 503.

The filtration control unit 504 mixes the variable parameters to create an adaptive filter control signal 507. The adaptive filter control signal defines the transfer function used by the adaptive filter 505.

User-set variable input parameter controls 501 are useful to tune the transfer function by the user to the preference of the user. The user set variable input parameter controls 501 may be established to permit the user to select a profile for the transfer function. Various profile controls can be provided to the user. For example, a profile specifically tuned to the environment inside of a passenger train. A profile specifically tuned to the environment in a jet airliner, a profile specifically tuned to the environment inside a subway train. The user adjustable controls may be a single control or multiple controls. They may correlate to conventional audio parameters such as bass, treble, frequency response. The user control parameters may be specifically engineered to modify the response of the adaptive filter according to conventional or non-conventional parameters. The user set variable input parameter controls may be controlled through switches and/or knobs on a connected interface or through a software implemented display interface such as a touchscreen. The touchscreen may be on a dedicated interface device or may be implemented in a personal electronic device such as a smart phone.

Audio analysis based variable controls may be based on a computerized assessment of the ambient audio source signal. The analysis of the ambient source audio may provide input to the filtration control unit 504 to modify the adaptive filter response based on analysis of background noise and/or dominant noise. For example, the audio analysis may assess the background noise typically present on a city street and the result of that analysis is used to influence the filtration control unit 504. The audio analysis may also detect dominant noise, in this example a jackhammer being operated at a construction site, to further influence the filtration control to provide an input to the adaptive filter to compensate for the dominant noise source.

The identification based variable parameter input unit 503 may provide input to the filtration control unit 504 to influence the response of the adaptive filter 505. Identification based variable parameters are further described in connection with FIG. 6.

The environmental identification may be provided in the form of a local radio beacon transmitting identification based variables. The local beacon may be transmitting Bluetooth, Wi-Fi or other radio signals. The identification may also be based on location services such as those available in an iOS or Android device. The available variables are provided to the filtration control unit 504 which combines or mixes the signals to generate an adaptive filter control signal 507. The adaptive filter control signal 507 is provided to the adaptive filter 505 and defines the transformation applied to the audio source 403.

Figure 6:
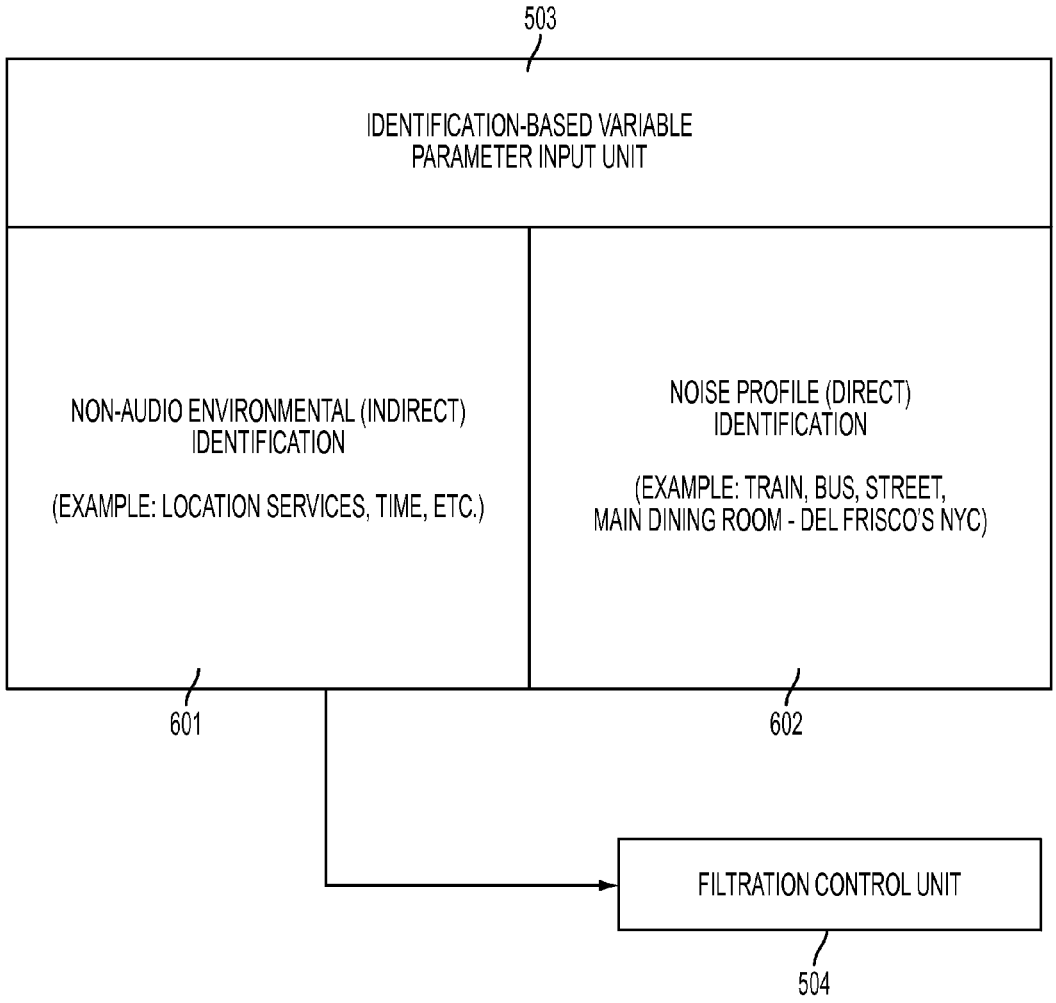
FIG. 6 shows a non-audio based identification input.

FIG. 6 illustrates identification based adaption non-audio-based variable parameter input unit 503 in order to provide an input to the filtration control unit 504. The identification based variable parameter input unit 503 obtains non-audio environmental identification signals. These non-audio environmental identification signals may serve as an index to noise profile compensation control. The noise profile compensation control may be generic or specific to a particular location. Examples of generic profiles include a passenger train, a bus, a city street, etc. Examples of specific profiles, for example, the main dining in Del Frisco's restaurant in New York City. Or inside of a 1970 Chevelle SS with a well-tuned 396 cubic inch V8 engine.

Figure 7:
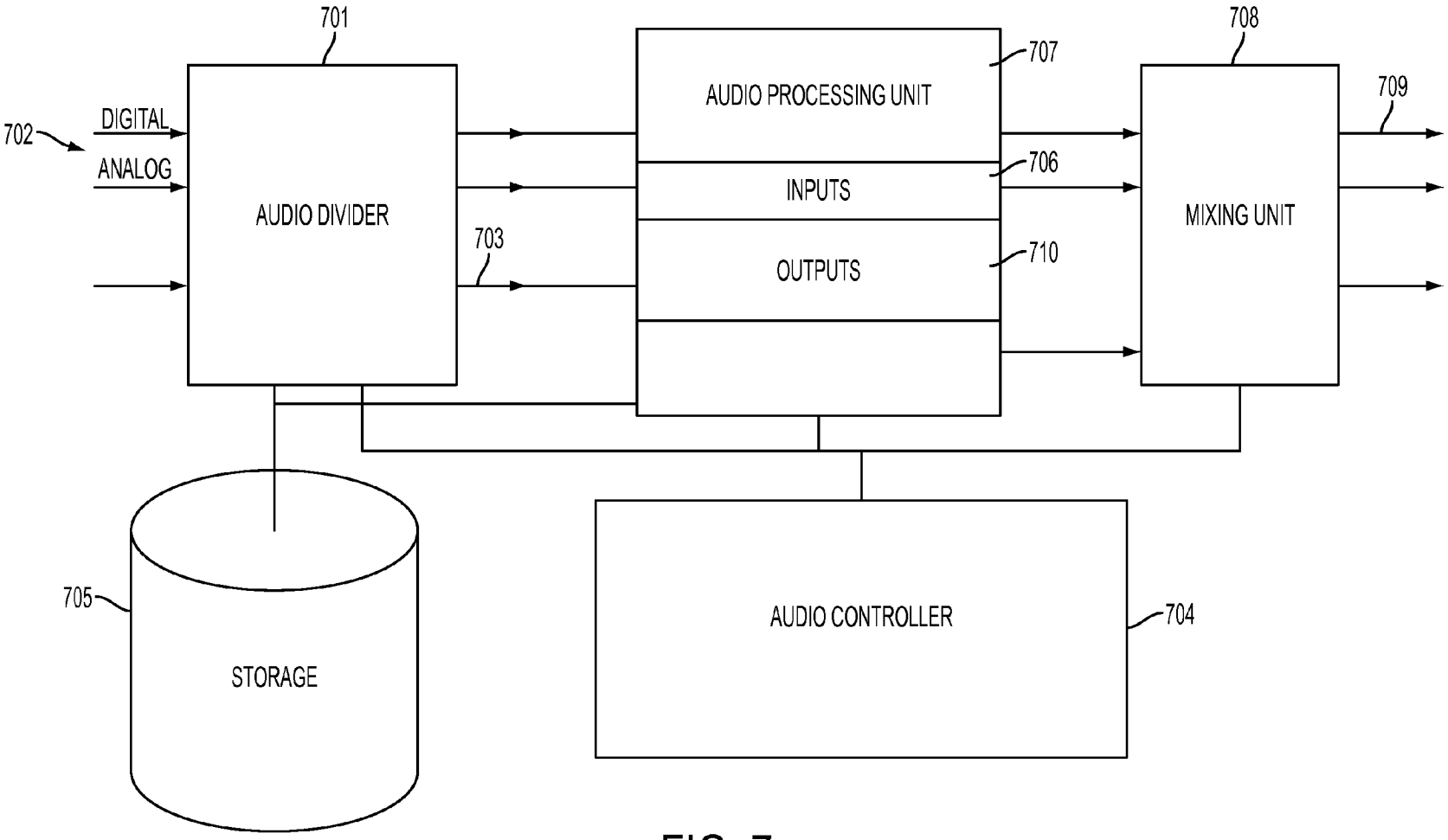
FIG. 7 shows an embodiment of an audio customization system.

FIG. 7 shows an audio customization system. The system includes an audio divider 701. The audio divider has one or more audio inputs 702. The audio inputs may be digital or analog signals. According to the preferred embodiment, analog signals may be digitized using an analog to digital converter. The analog inputs may be connected to microphones, instruments, pre-recorded audio or one or more audio source inputs like a board feed. The audio divider 701 may include one or more demultiplexers in order to separate different audio signals on the same input. The audio divider 701 also includes the capacity to divide input signals into multiple channels, for example, frequency domain channels.

The audio divider 701 may be implemented in a multichannel audio processor such as an STA311B available from ST Microelectronics. The STA311B has an automode that may divide an audio signal into eight frequency bands. Audio input signals may be divided, shaped or transferred according to controllable frequency bands or in any other manner that may be accomplished by a digital signal processor or other circuitry. The audio divider may have matrix switching capabilities to allow control of selecting which input(s) is connected to which channel output(s) 703.

The audio divider 701 may be connected to an audio controller 704 which may dictate the manner in which the audio input signals 702 are handled. Alternatively, the audio divider 701 may be static and transform the audio inputs 702 to channel outputs 703 according to a predefined scheme. In addition the audio divider 701 is connected to a storage unit 705 which may contain pre-recorded audio or audio profiles. The channel outputs 703 of the audio divider 701 are connected to the inputs 706 of an audio processing unit 707. The audio processing unit 707 is responsive to audio controller 704, and contains one or more adaptive filters to combine audio input signals 706. The audio controller 704 dictates which inputs are combined and the manner of combination. The audio processing unit 707 is connected to a mixing unit 708 which combines the channel outputs 703 of the audio processing unit 707 in a manner dictated by audio controller 704. The mixing unit 708 has one or more audio outputs (709). According to one embodiment, the mixing unit 708 may have a two-channel output for connection to a headphone (not shown).

Mixing may be accomplished using a digital signal processor. For example a Cirrus Logic C54700xx Audio-System-on-a-chip (ASOC) processor may be used to mix the outputs 710 of audio processing unit 707.

In practical implementation a single digital signal processor may be used to perform the functions of the audio divider 701, audio processing unit 707 and mixing unit 708.

FIG. 8 shows an illustration of an embodiment of the invention. FIG. 8A shows an integrated input/output headset 801. The headset may include left speaker 802 and right speaker 803. Speakers 802 and 803 may advantageously be connected by a headband 804. A microphone array 805 may be carried on the headband 804 and may include multiple microphones 806. Advantageously, the microphones 806 are directional.

Figure 8A:
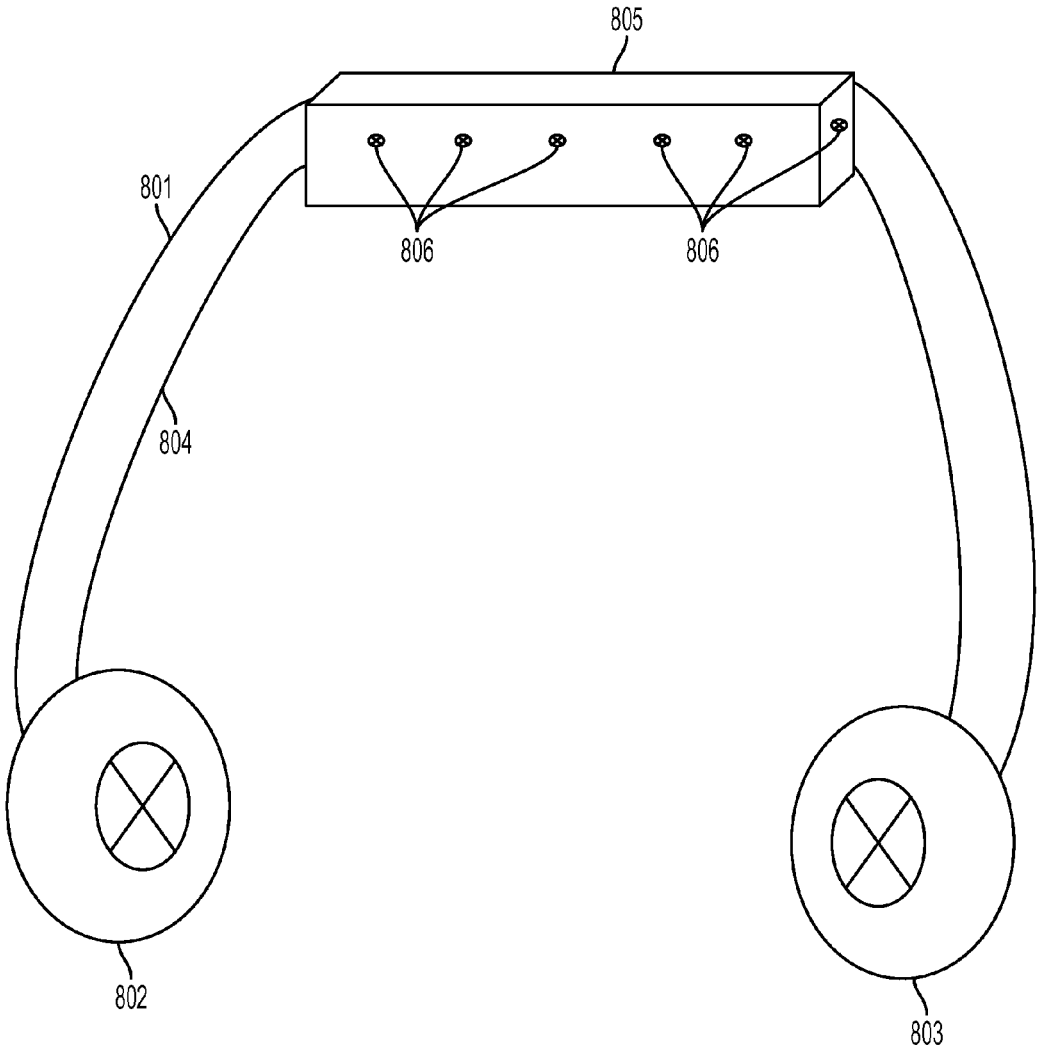
FIG. 8A shows an embodiment of the invention.
Figure 8B:
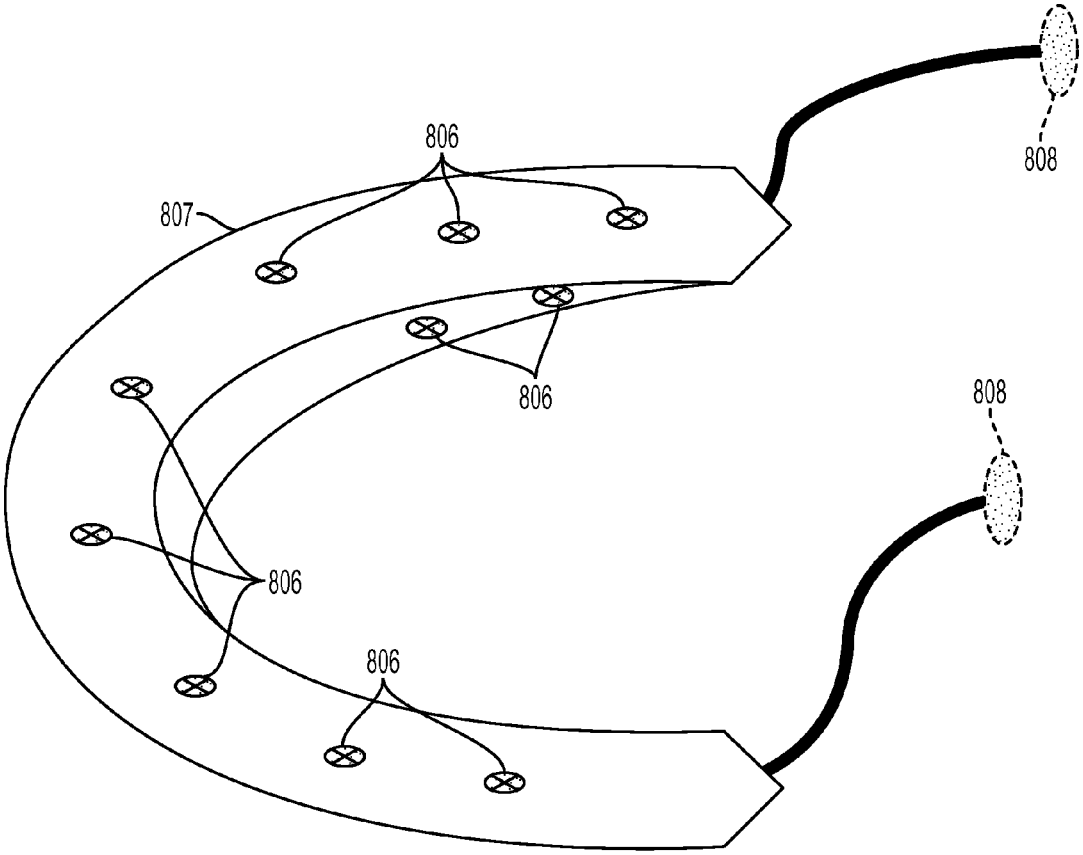
FIG. 8B shows an embodiment of the invention.

FIG. 8B shows an alternative embodiment of an input/output unit with microphones 806 located in a neckpiece housing 807 and including earphones 808.

Figure 8C:
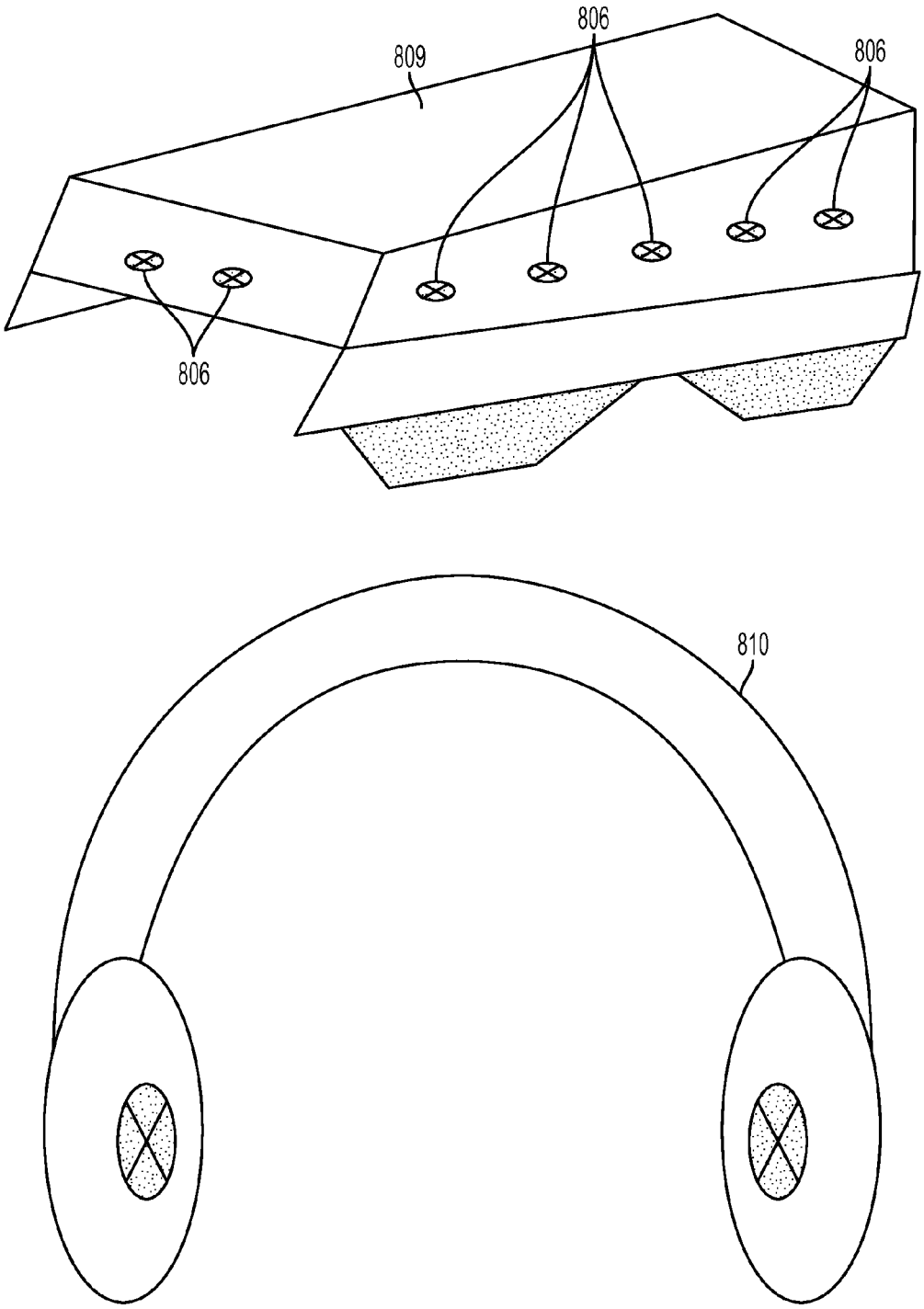
FIG. 8C shows an embodiment of the invention.

A third embodiment is illustrated in FIG. 8C. Conventional headphones 810 may be used as an audio output device. A microphone array 809 carrying a plurality of directional microphones 806 may be attached to the headband of a headphone 810.

Figure 8D:
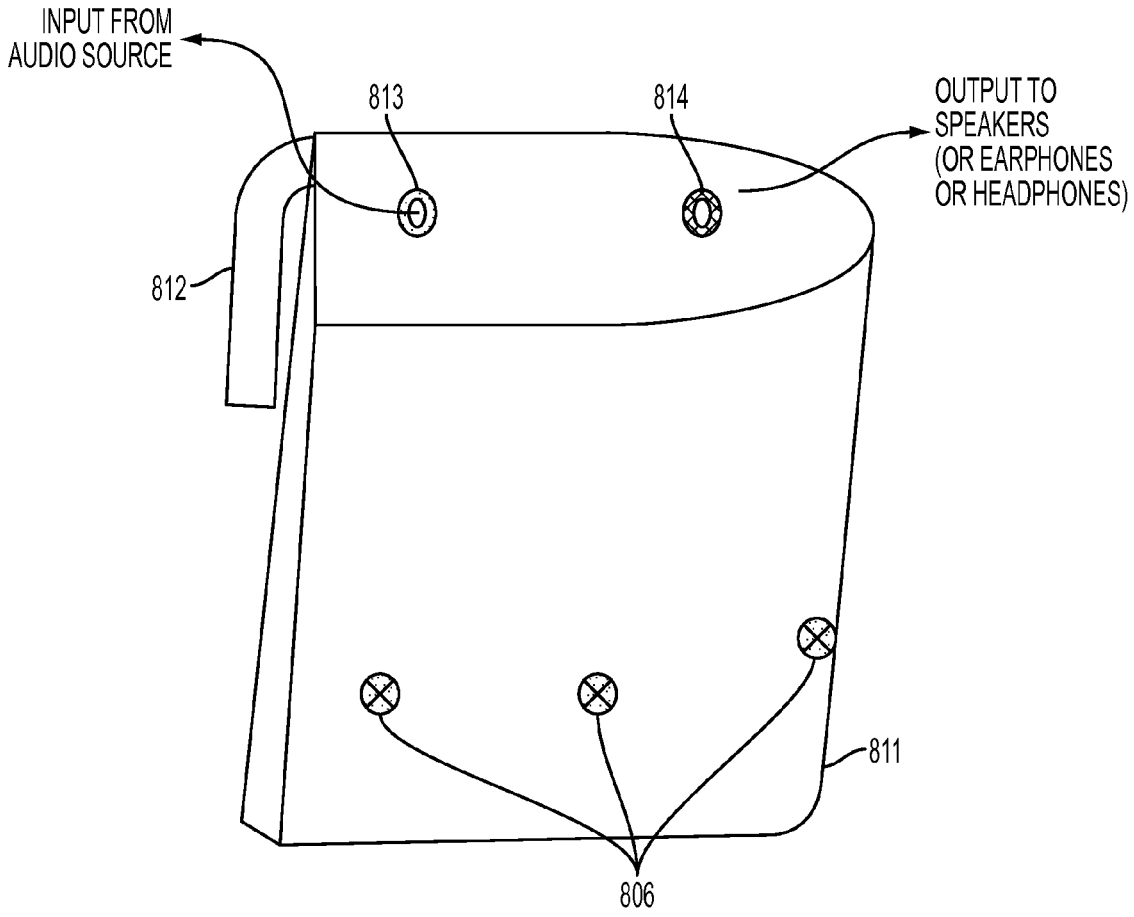
FIG. 8D shows an embodiment of the invention.

FIG. 8D shows an interface with a housing 811 designed to be connected to a belt or other structure by clip 812. The housing 811 may include one or more microphones 806, an input jack 813, and an output jack 814. The input jack 813 may be connected to an audio source such as an mp3 player. The output jack 814 may be connected to speakers, an earphone set or a headphone set.

Figure 8E:
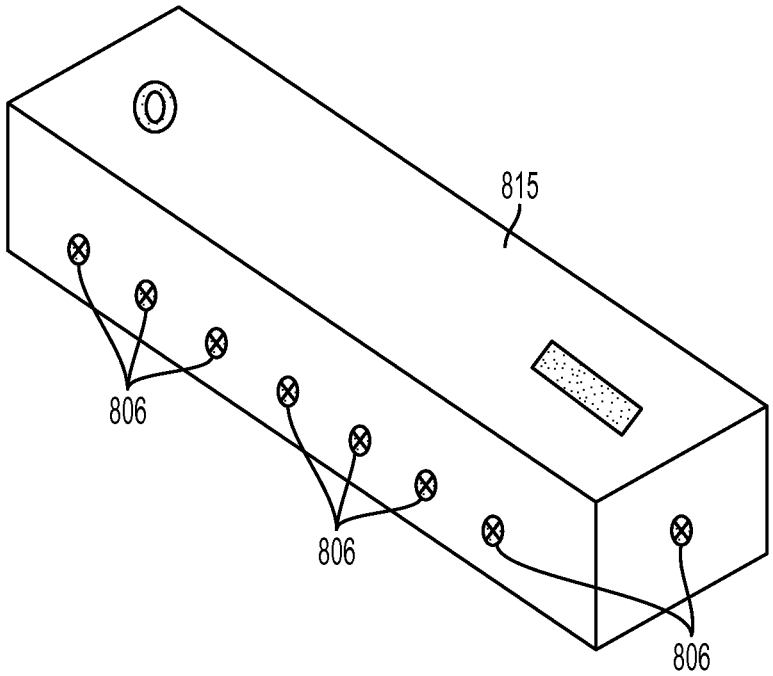
FIG. 8E shows an embodiment of the invention.

A further embodiment shown in FIG. 8E includes a housing 815 configured for connection to a smartphone such as an iPhone or Android phone. The housing 815 may be integrated with or connected to a smartphone case. The device shown in FIG. 8E may include one or more sensor microphones 806. Advantageously, a plurality of directional microphones may be used. Alternatively, one or more omnidirectional microphones may be used. The housing 815 may have a connector 816 suitable for electrically connecting the device to a smartphone. In the smartphone embodiment shown in FIG. 8E, the smartphone or other portable electronic device (not shown) may include application software operating as a user control. The signal processing capability may be incorporated into the smartphone or be performed by a separate processor located in the housing.

In each of the embodiments 8A, 8B, 8C, 8D, and 8E, user controls may be provided for in a connected input/output device such as a smartphone or by controls mounted on any of housings 805, 807, 809, 811 or 815. In addition, an audio divider 702 and mixing unit 708 may be provided for either within the microphone housings or control unit. In addition, connections between the input/output devices, audio inputs, audio processing unit, and mixing unit may be by wired or wireless connections. The same holds true for the controller and audio divider and/or storage if utilized.

FIG. 9A-G shows alternative aspects of a user control interface for use and connection with the audio optimization system according to the invention.

Figure 9A:
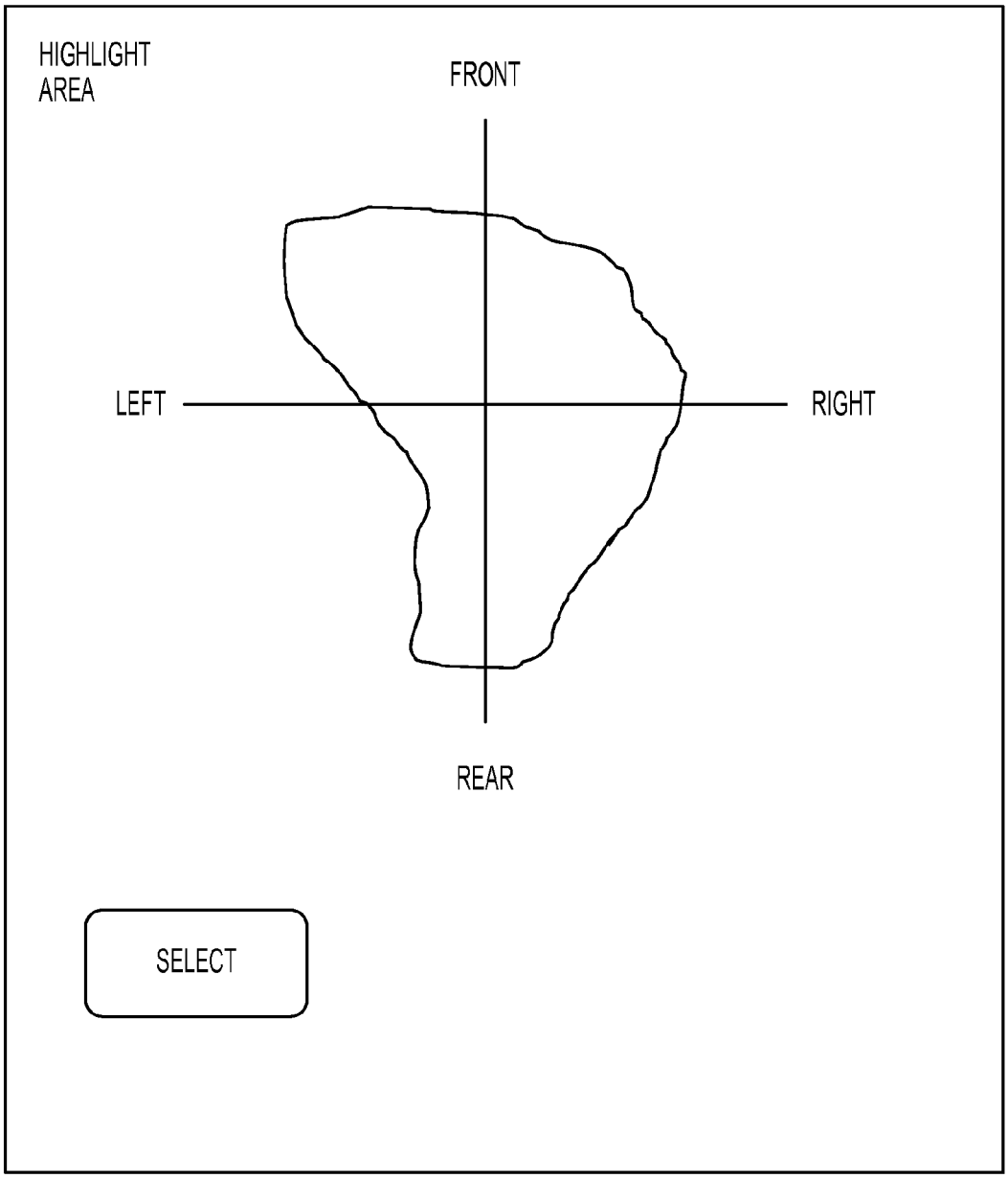
FIG. 9A shows an embodiment of a user control interface.

FIG. 9A shows a user control interface useful to control noise cancellation according to direction of noise source.

Figure 9B:
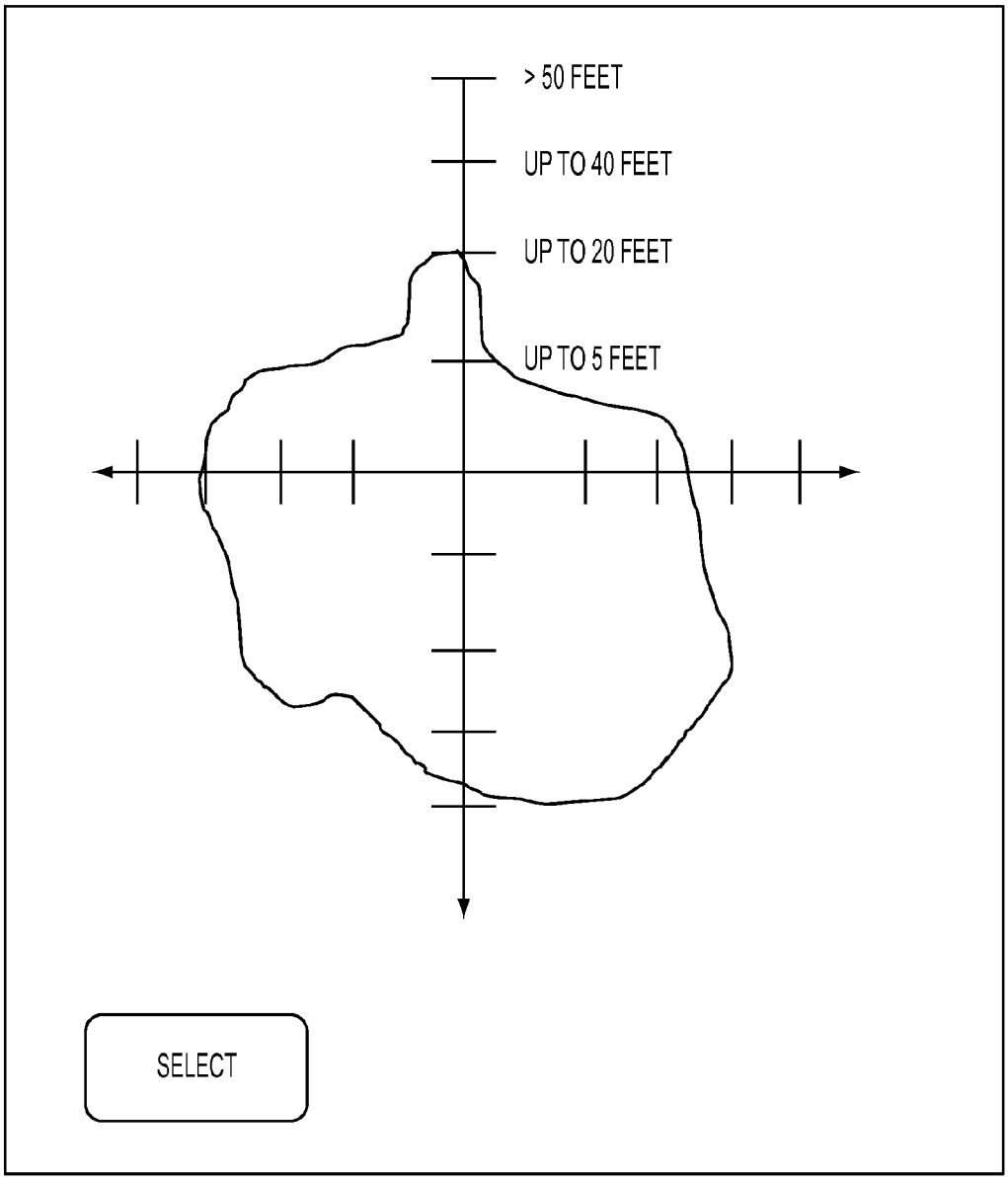
FIG. 9B shows an embodiment of a user control interface.

FIG. 9B shows a user control interface suitable for controlling direction and distance of audio subject to noise cancellation.

Figure 9C:
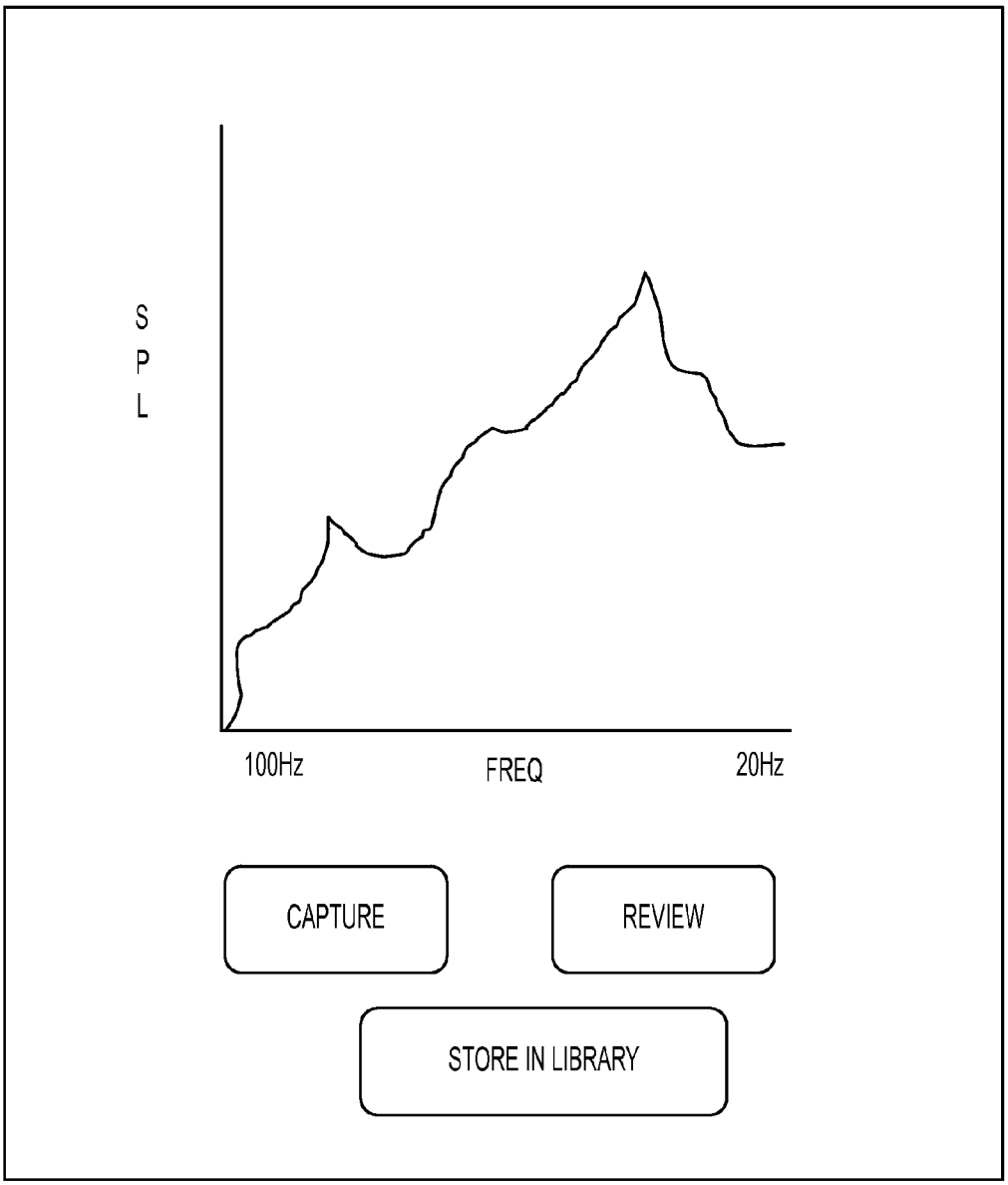
FIG. 9C shows an embodiment of a user control interface.

FIG. 9C shows a user control interface to facilitate a user capturing audio to serve as a model for enhancement or cancellation. The interface of FIG. 9B to record a sample audio that is to be exempted from cancellation, enhanced or specifically subject to cancellation. For example a particular ringtone or alarm may be recorded and stored to serve as a profile to permit the same or similar audio to be transferred to the audio output.

The user control interface may also include controls for channels, volume, bass, treble, midrange, other frequency ranges, selection of cancellation algorithm or profile, selection of enhancement algorithm or profile, feature on/off switches, etc.

Figure 9D:
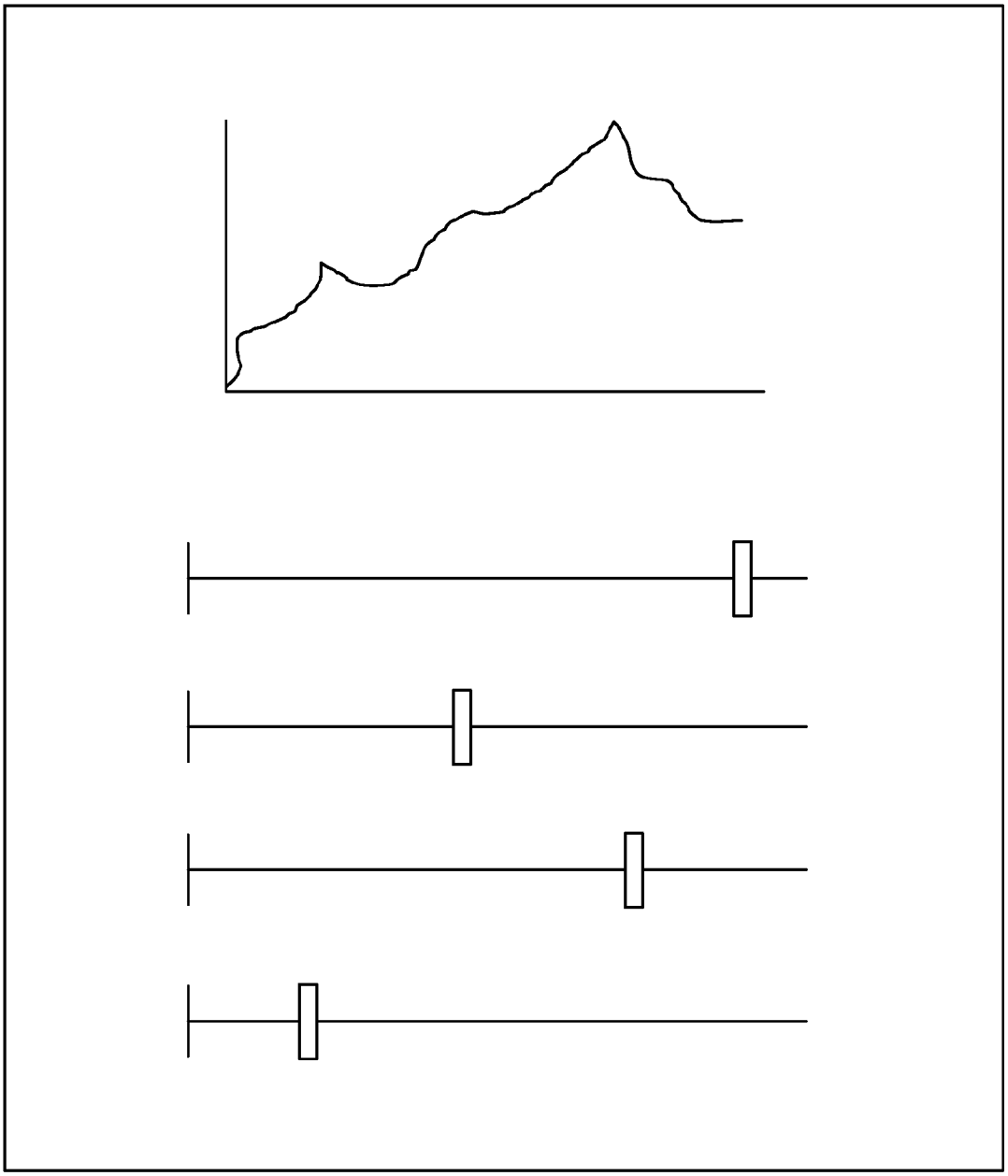
FIG. 9D shows an embodiment of a user control interface.

FIG. 9D shows a user control interface including a display of a representation of an ambient sound and sliders to change or customize audible parameters in an audio library.

Figure 9E:
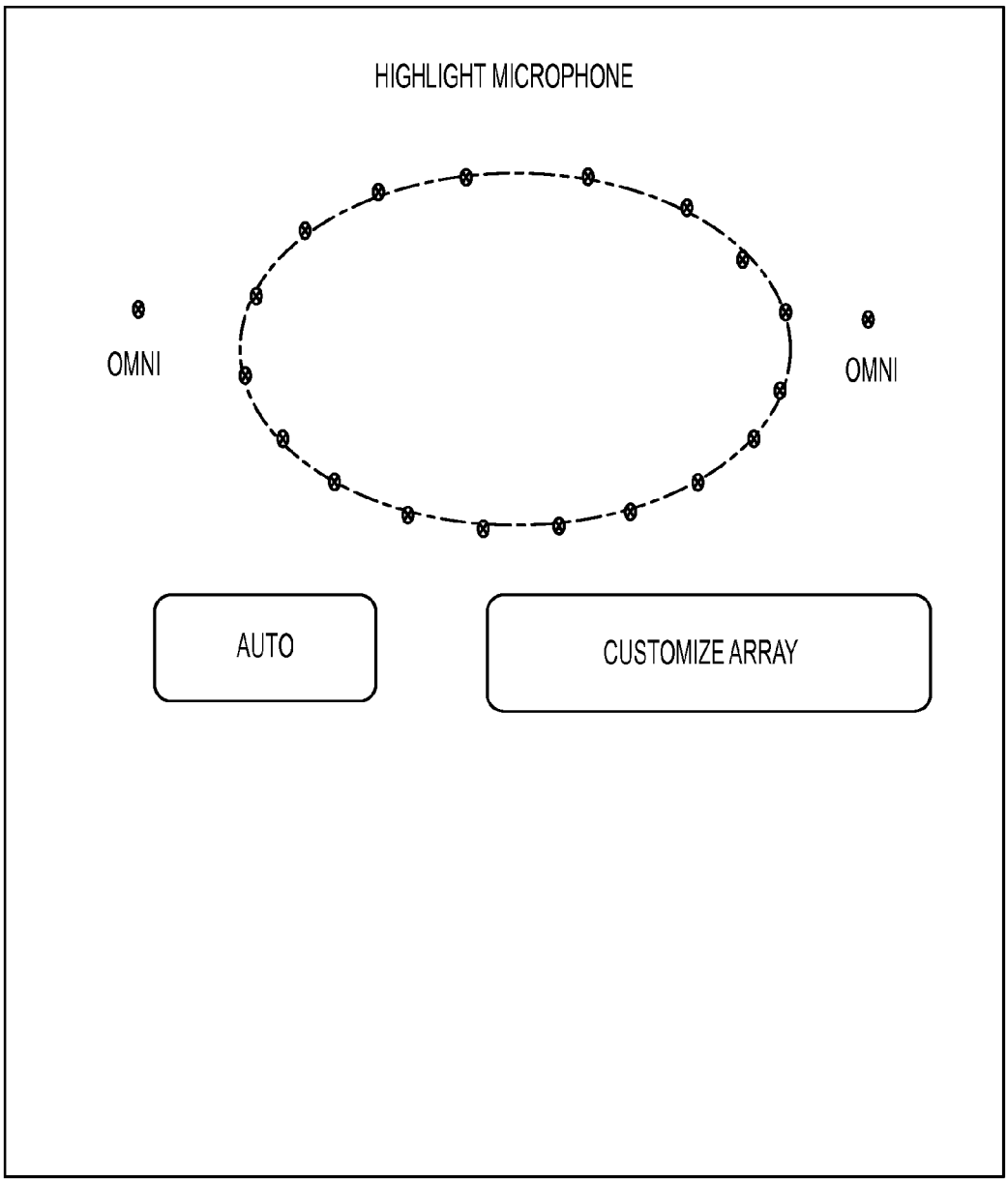
FIG. 9E shows an embodiment of a user control interface.

FIG. 9E shows a user control interface designed for microphone selection.

Figure 9F:
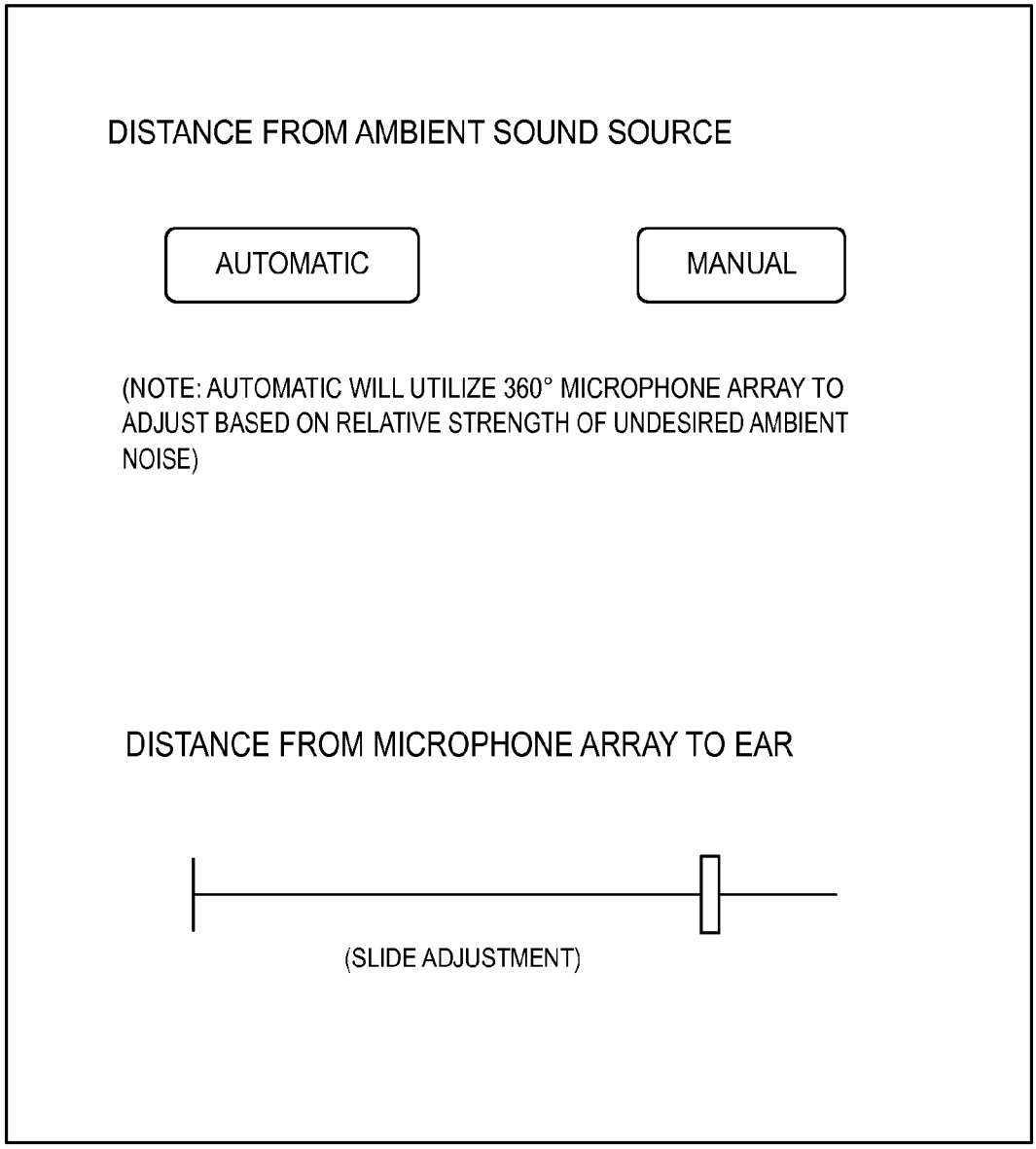
FIG. 9F shows an embodiment of a user control interface.

FIG. 9F shows a user control interface including a display allowing selection of distance from ambient sound source and/or microphone array.

Figure 9G:
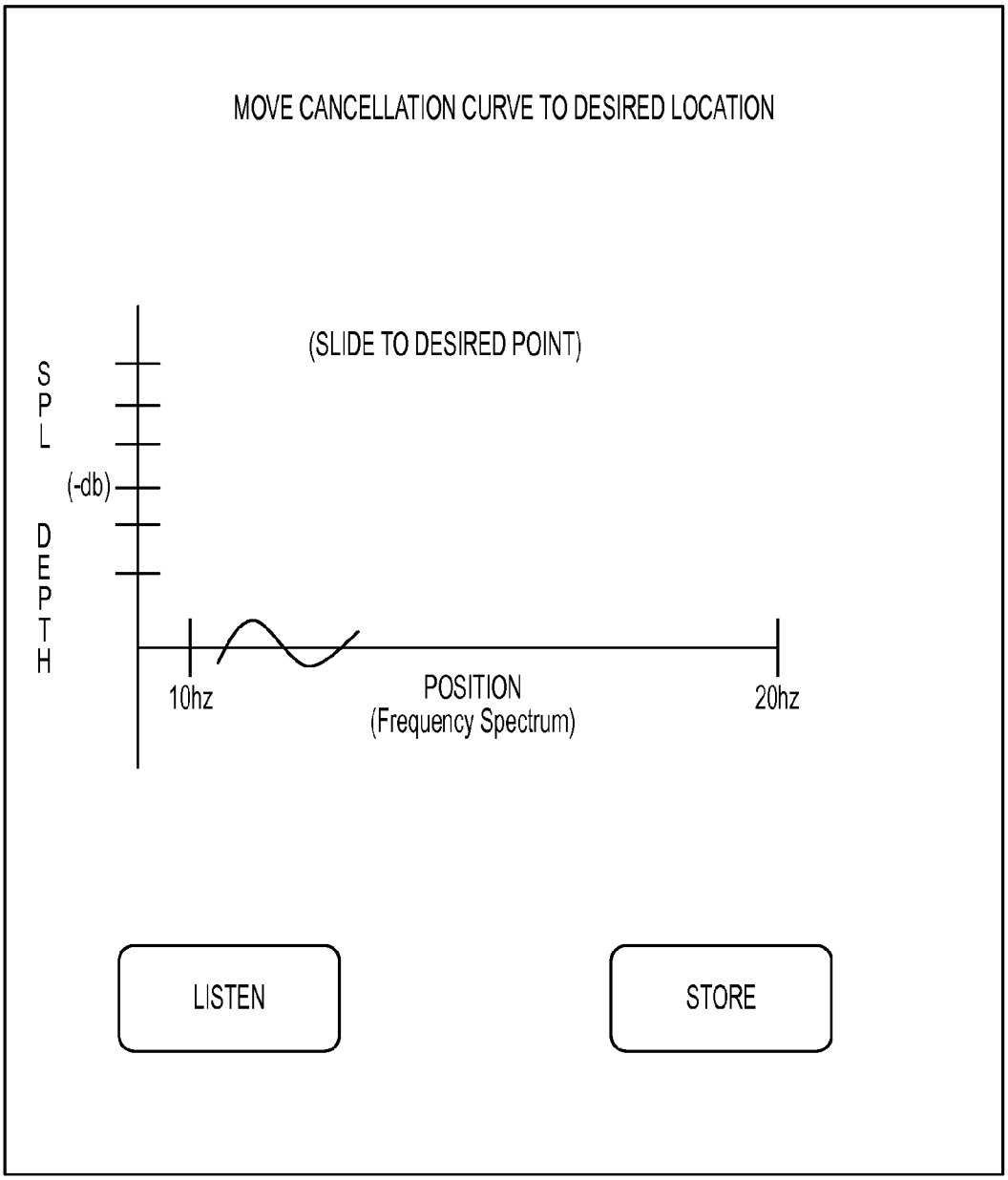
FIG. 9G shows an embodiment of a user control interface.

FIG. 9G shows a user control interface including a display corresponding to a noise cancellation algorithm and user input controls.

Figure 10:
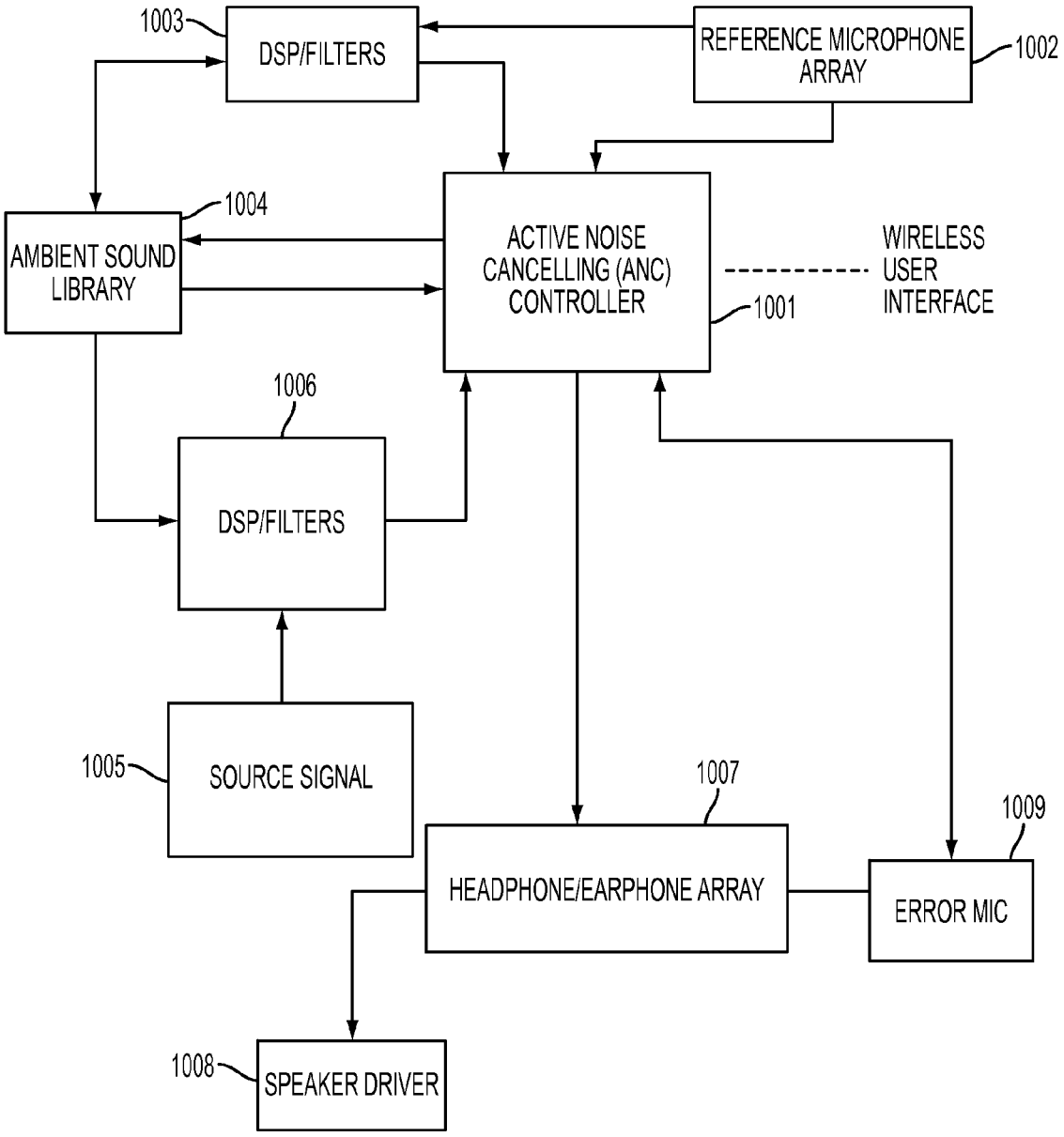
FIG. 10 shows a system layout according to an embodiment of the invention.

FIG. 10 shows a system layout according to an embodiment of the invention. An adaptive noise controller 1001 is provided. The adaptive noise controller 1001 may be connected to a reference microphone array 1002 and to a set of digital filters 1003. The reference microphone array 1002 may also be connected to the digital filters 1003. The digital filters 1003 may rely on ambient sound profiles stored in an ambient sound library 1004 also connected to the adaptive noise controller 1001. A source signal 1005 may be connected to digital filters 1006 which in turn are connected to ambient sound library 1004 and adaptive noise controller 1001. Output devices such as earphone/headphone 1007 may be connected to the adaptive noise controller 1001 and may be connected to a speaker driver 1008. One or more error microphones 1009 may be connected to the adaptive noise controller 1001 and/or the headphone/earphone array 1007.

The techniques, processes and apparatus described may be utilized to control operation of any device and conserve use of resources based on conditions detected or applicable to the device.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of audio signature generation and automatic content recognition have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An active noise control system comprising:

an adaptive filter having a source audio input and an audio signal output;

a filtration control connected to said adaptive filter;

a variable input control connected to said filtration control wherein said variable input control dynamically influences said filtration control;

wherein said variable input control is an identification based variable input control;

wherein said identification based variable input is a non-audio environmental identification based variable input control;

wherein said non-audio environmental identification based variable input control is a location service based variable input control; and wherein said location service based variable input control further comprises a database containing adaptive filter parameters indexed according to non-audio parameters; and a non-audio monitor connected to said database.

2. An active noise control system according to claim 1 wherein said variable input control is a user control.

3. An active noise control system according to claim 1 wherein said variable input control is a dynamic audio analysis unit.

4. An active noise control system according to claim 1 wherein said identification based variable input control further comprises an audio based variable input control.

5. An active noise control system according to claim 4 wherein said audio based input control further comprises a database containing adaptive filter parameters indexed according to audio based parameters; and an audio monitor connected to said database.

6. An active noise control system according to claim 1 wherein said non-audio environmental identification-based variable input control further comprises an adaptive filter control responsive to an environmental input.

* * * * *